US011571890B2

(12) United States Patent
Kishikawa

(10) Patent No.: US 11,571,890 B2
(45) Date of Patent: Feb. 7, 2023

(54) LIQUID DISCHARGE HEAD, LIQUID DISCHARGE APPARATUS, LIQUID DISCHARGE MODULE, AND MANUFACTURING METHOD FOR LIQUID DISCHARGE HEAD

(71) Applicant: CANON KABUSHIKI KAISHA, Tokyo (JP)

(72) Inventor: Shinji Kishikawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 17/315,165

(22) Filed: May 7, 2021

(65) Prior Publication Data

US 2021/0354463 A1 Nov. 18, 2021

(30) Foreign Application Priority Data

May 13, 2020 (JP) ..... JP2020-084708

(51) Int. Cl.
*B41J 2/14* (2006.01)
*B41J 2/16* (2006.01)

(52) U.S. Cl.
CPC ..... *B41J 2/14145* (2013.01); *B41J 2/1601* (2013.01); *B41J 2/1626* (2013.01)

(58) Field of Classification Search
CPC .... B41J 2/14145; B41J 2/1601; B41J 2/1626; B41J 2/1603; B41J 2/1631; B41J 2/1645; B41J 2/1404; B41J 2202/12; B41J 2/01
See application file for complete search history.

(56) References Cited

FOREIGN PATENT DOCUMENTS

JP H06305143 A 11/1994

OTHER PUBLICATIONS

IP.com search (Year: 2022).*

* cited by examiner

*Primary Examiner* — Lisa Solomon
(74) *Attorney, Agent, or Firm* — Canon U.S.A., Inc. I.P. Division

(57) ABSTRACT

A liquid discharge head includes a substrate, a pressure chamber through which a first liquid and a second liquid flow while being in contact with each other, a pressure generating element configured to pressurize the first liquid, and a discharge port configured to discharge the second liquid. The substrate has a first channel and a second channel that each extend through the substrate. The first channel is used to supply the first liquid to the pressure chamber. The second channel is used to supply the second liquid to the pressure chamber. A viscosity of the second liquid is greater than a viscosity of the first liquid. An average cross-section area of the second channel is greater than an average cross-section area of the first channel.

13 Claims, 17 Drawing Sheets

30
31
32
12
15
16
T
H
z
x
y 30
14
12
15
32
31
$h_r = 0.00$
$h_r = 0.10$
$h_r = 0.20$
$h_r = 0.30$
$h_r = 0.40$
$h_r = 0.50$
$h_r = 1.00$
z
x
y 30
14
15
12
31
32
$h_r = 0.12$
$h_r = 0.24$
$h_r = 0.36$
$h_r = 0.48$
$h_r = 0.60$
z
x
y

LIQUID DISCHARGE HEAD, LIQUID DISCHARGE APPARATUS, LIQUID DISCHARGE MODULE, AND MANUFACTURING METHOD FOR LIQUID DISCHARGE HEAD

BACKGROUND

Field of the Disclosure

The present disclosure generally relates to a liquid discharge head, a liquid discharge apparatus, a liquid discharge module, and a manufacturing method for a liquid discharging head.

Description of the Related Art

A liquid discharge head that discharges a liquid includes an element substrate. The element substrate has discharge ports that discharge liquid, pressure generating elements that each generate a pressure for discharging liquid through an associated one of the discharge ports, and the like. Japanese Patent Laid-Open No. 6-305143 describes a liquid discharge head. The liquid discharge head brings a liquid that is a discharge medium and a liquid that is a bubbling medium into contact with each other at an interface and discharges the discharge medium as a result of the growth of a bubble generated in the bubbling medium by application of thermal energy. Japanese Patent Laid-Open No. 6-305143 describes a method of stabilizing the interface between a discharge medium and a bubbling medium within a liquid channel by, after the discharge of the discharge medium, pressurizing the discharge medium and the bubbling medium to form a flow.

As described in Japanese Patent Laid-Open No. 6-305143, two channels that extend through a substrate of the element substrate are formed in the substrate in order to form the flow of two liquids (a discharge medium and a bubbling medium). When the cross-section area of each channel is simply increased in the thus configured element substrate to try to improve liquid refillability, the strength of the substrate decreases, and, therefore, the substrate may be broken.

SUMMARY

The present disclosure generally provides a liquid discharge head capable of suppressing a decrease in the strength of a substrate while improving liquid refillability.

An aspect of the present invention provides a liquid discharge head. The liquid discharge head includes a substrate, a pressure chamber through which a first liquid and a second liquid flow while being in contact with each other, a pressure generating element configured to pressurize the first liquid, and a discharge port configured to discharge the second liquid. The substrate has a first channel and a second channel that each extend through the substrate. The first channel is used to supply the first liquid to the pressure chamber. The second channel is used to supply the second liquid to the pressure chamber. A viscosity of the second liquid is greater than a viscosity of the first liquid. An average cross-section area of the second channel is greater than an average cross-section area of the first channel.

Further features of the present disclosure will become apparent from the following description of exemplary embodiments with reference to the attached drawings.

DESCRIPTION OF THE EMBODIMENTS

Configuration of Liquid Discharge Head

Figure 1:
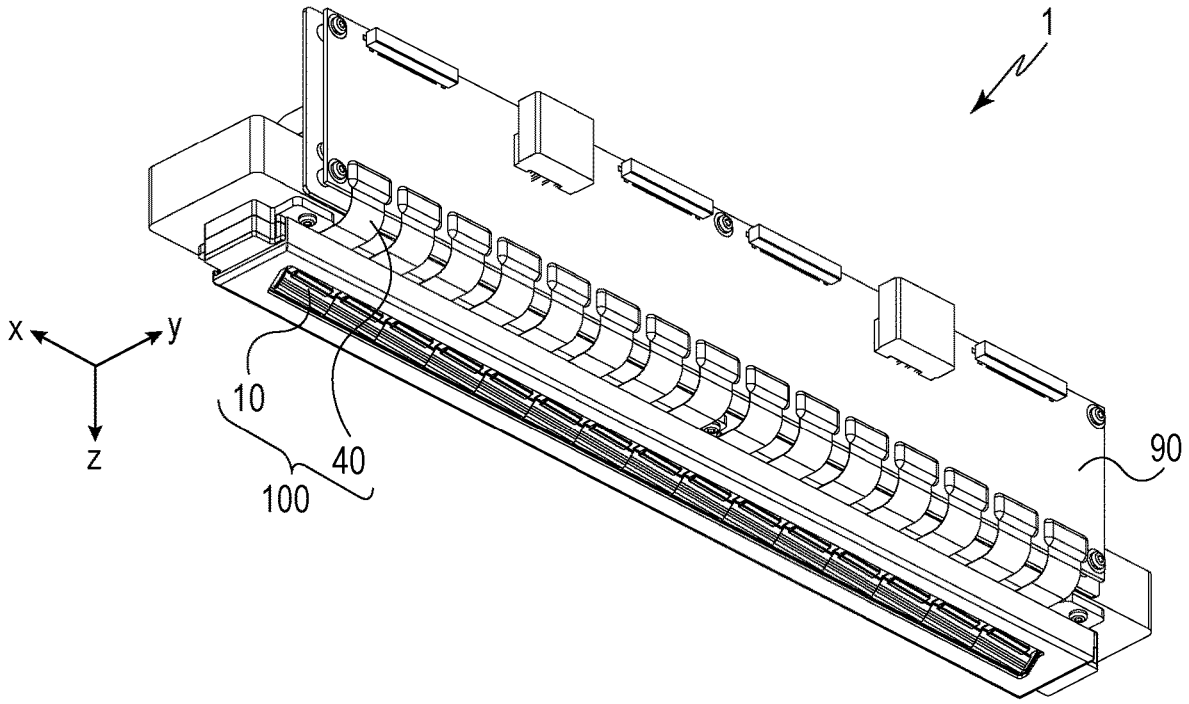
FIG. 1 is a perspective view of a discharge head.

FIG. 1 is a perspective view of a liquid discharge head 1 usable in the present disclosure. The liquid discharge head 1 of the present embodiment is configured such that a plurality of liquid discharge modules 100 is arranged in an x direction. Each individual liquid discharge module 100 includes an element substrate 10 in which a plurality of pressure generating elements 12 (see FIG. 4) is arranged, and a flexible printed circuit board 40 used to supply electric power and a discharge signal to each individual discharge element. Each of the flexible printed circuit boards 40 is connected in common to an electrical wiring board 90 on which electric power supply terminals and discharge signal input terminals are disposed. The liquid discharge module 100 can be simply attached to or detached from the liquid discharge head 1. Thus, any liquid discharge module 100 can be easily attached to or detached from the liquid discharge head 1 without disassembling the liquid discharge head 1.

In this way, for the liquid discharge head 1 made up of the plurality of liquid discharge modules 100 arranged in a longitudinal direction, even when there occurs a discharging failure in any one of the pressure generating elements 12 or other elements, only the liquid discharge module 100 in which a failure has occurred is replaced. Thus, yields in a manufacturing process for the liquid discharge head 1 are improved, and cost at the time of head replacement is reduced.

Configuration of Liquid Discharge Apparatus

Figure 2:
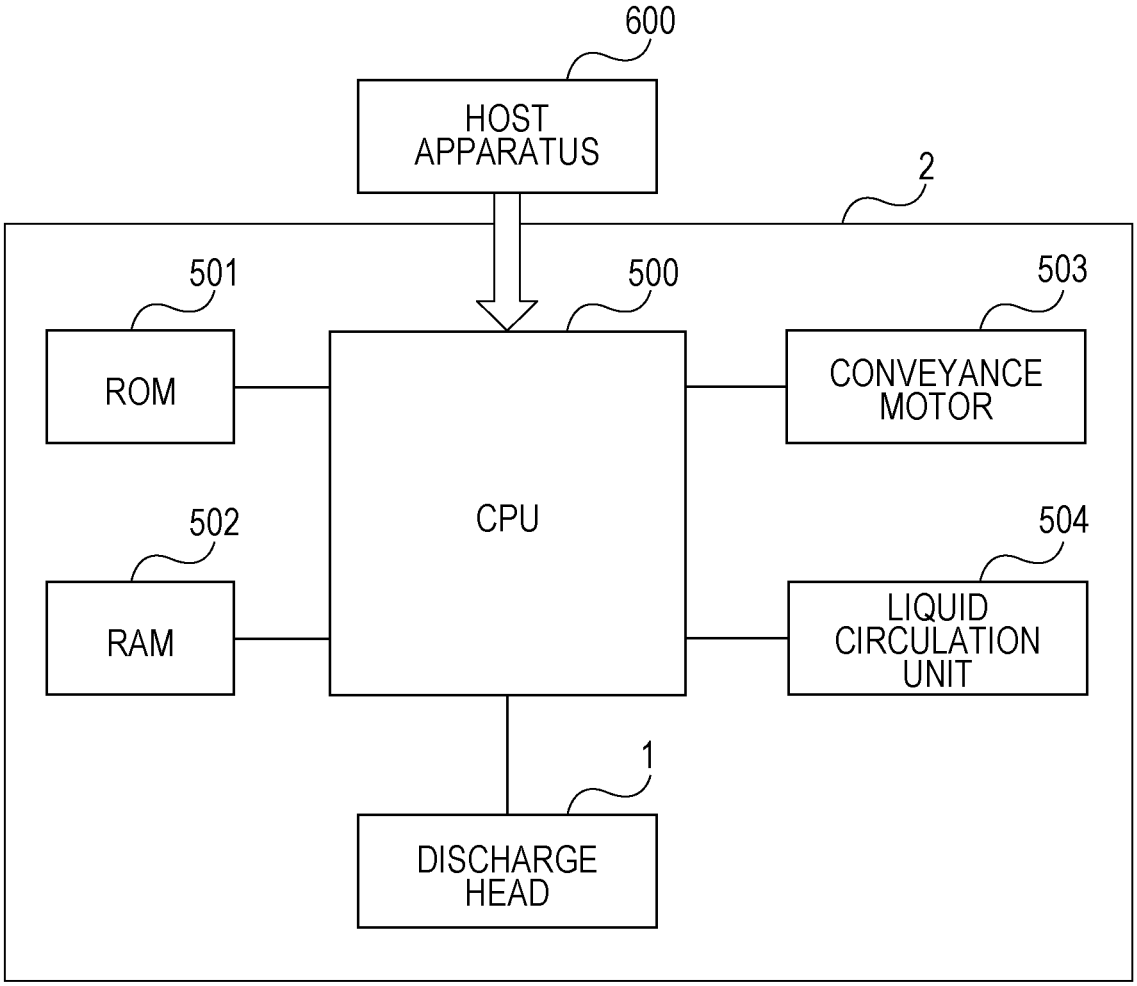
FIG. 2 is a block diagram for illustrating a control configuration of a liquid discharge apparatus.

FIG. 2 is a block diagram showing a control configuration of a liquid discharge apparatus 2 usable in the present disclosure. A CPU 500 controls the overall liquid discharge apparatus 2 while using RAM 502 as a work area in accordance with programs stored in ROM 501. The CPU 500, for example, performs predetermined data processing on discharge data received from an externally connected host apparatus 600 in accordance with programs and parameters stored in the ROM 501, and generates a discharge signal based on which the liquid discharge head 1 is able to perform discharging. The CPU 500 conveys a target medium in a predetermined direction by driving a conveyance motor 503 while driving the liquid discharge head 1 in accordance with the discharge signal, thus applying liquid discharged from the liquid discharge head 1 to the target medium.

A liquid circulation unit 504 is a unit for controlling the flow of liquid in the liquid discharge head 1 by supplying liquid to the liquid discharge head 1 while circulating the liquid. The liquid circulation unit 504 includes a sub tank that stores liquid, a channel that circulates liquid between the sub tank and the liquid discharge head 1, a plurality of pumps, a flow regulating unit for adjusting the flow rate of liquid flowing inside the liquid discharge head 1, and the like. Under an instruction from the CPU 500, the liquid circulation unit 504 controls the above-described mechanisms such that liquid flows at a predetermined flow rate in the liquid discharge head 1.

Configuration of Element Substrate

Figure 3:
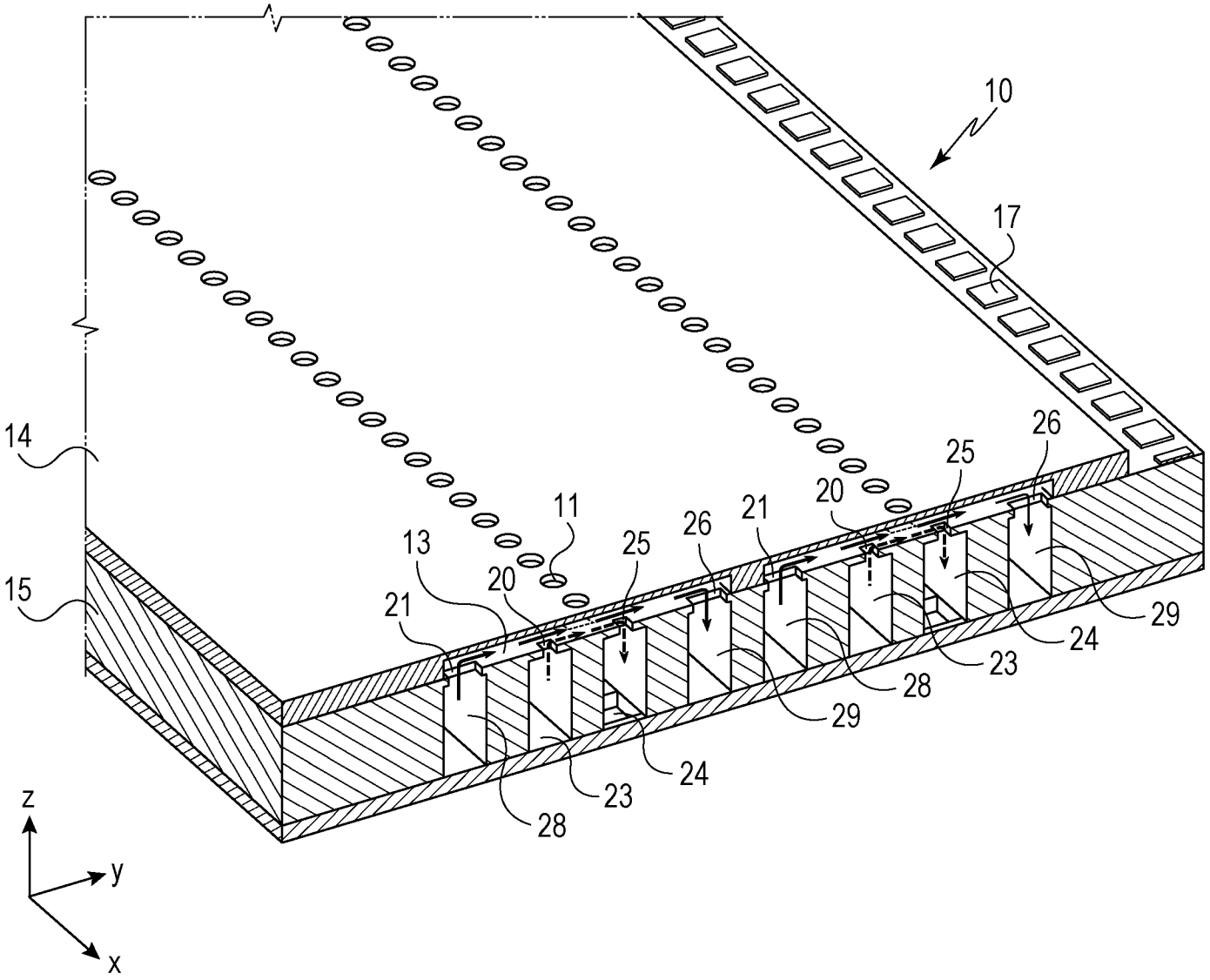
FIG. 3 is a cross-sectional perspective view of an element substrate in a liquid discharge module.

FIG. 3 is a cross-sectional perspective view of the element substrate 10 provided in each individual liquid discharge module 100. The element substrate 10 is made such that an orifice plate 14 (discharge port forming member) is laminated on a silicon (Si) substrate 15. In FIG. 3, discharge ports 11 arranged in the x direction discharge a liquid of the same type (for example, a liquid supplied from a common sub tank or supply port). Here, an example in which the orifice plate 14 also has liquid channels 13 is shown. Alternatively, the liquid channels 13 may be formed by another member (channel wall member), and the orifice plate 14 having the discharge ports 11 may be provided on the channel wall member. The liquid channels 13 are formed on the substrate 15.

The pressure generating elements 12 (not shown in FIG. 3) are respectively disposed at positions corresponding to the individual discharge ports 11 on the silicon substrate (hereinafter, also simply referred to as substrate) 15. The discharge ports 11 and the pressure generating elements 12 are provided at facing positions. When a voltage is applied according to a discharge signal, the pressure generating element 12 pressurizes liquid in a z direction intersecting with a flow direction (y direction), and the liquid is discharged as a liquid droplet through the discharge port 11 facing the pressure generating element 12. Electric power and a drive signal for the pressure generating element 12 are supplied from the flexible printed circuit board 40 (see FIG. 1) via a terminal 17 disposed on the substrate 15.

A plurality of the liquid channels 13 is formed in the orifice plate 14. Each of the liquid channels 13 extends in the y direction and individually connects with a corresponding one of the discharge ports 11. The first common supply channel 23, the first common collecting channel 24, the second common supply channel 28, and the second common collecting channel 29 are connected in common to the plurality of liquid channels 13 arranged in the x direction. The flow of liquid in the first common supply channel 23, the first common collecting channel 24, the second common supply channel 28, and the second common collecting channel 29 is controlled by the liquid circulation unit 504 described with reference to FIG. 2. Specifically, a first liquid flowing from the first common supply channel 23 into each liquid channel 13 is controlled to flow toward the first common collecting channel 24, and a second liquid flowing from the second common supply channel 28 into each liquid channel 13 is controlled to flow toward the second common collecting channel 29. The first common supply channel 23, the first common collecting channel 24, the second common supply channel 28, and the second common collecting channel 29 are connected to the plurality of liquid channels 13 arranged in the x direction.

FIG. 3 shows an example in which two sets of the thus configured discharge ports 11 and the liquid channels 13 arranged in the x direction are arranged in they direction. FIG. 3 shows a configuration in which the discharge ports 11 are disposed at positions facing the pressure generating elements 12, that is, in a bubble growth direction; however, the present embodiment is not limited thereto. Discharge ports may be provided at, for example, positions orthogonal to a bubble growth direction.

Configuration of Liquid Channel and Pressure Chamber

Figure 4A:
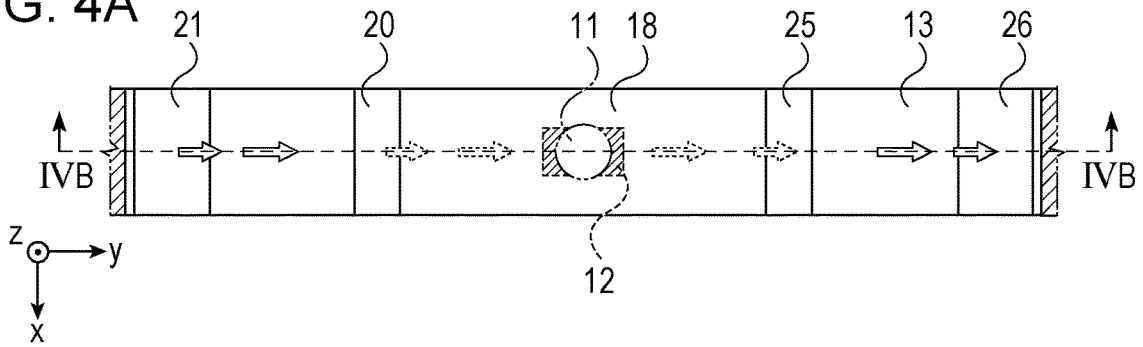
FIG. 4A to FIG. 4D are enlarged detail views of a liquid channel and a pressure chamber.
Figure 4B:
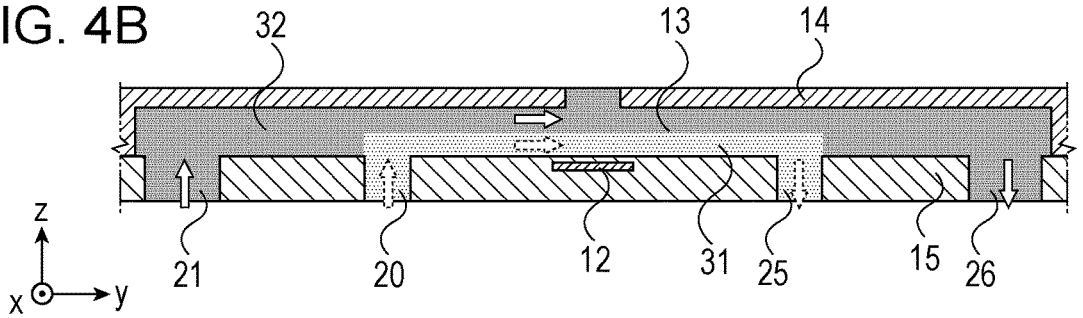
Figure 4C:
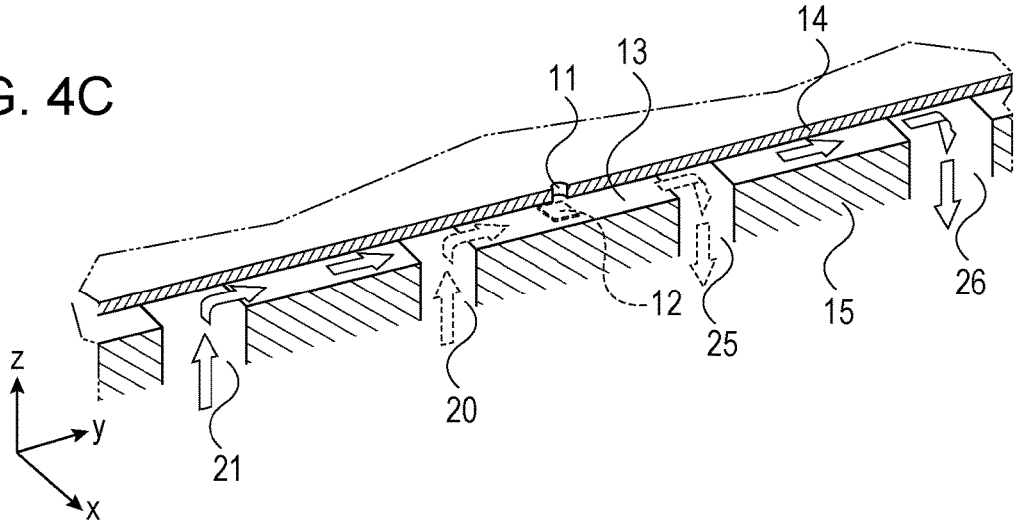
Figure 4D:
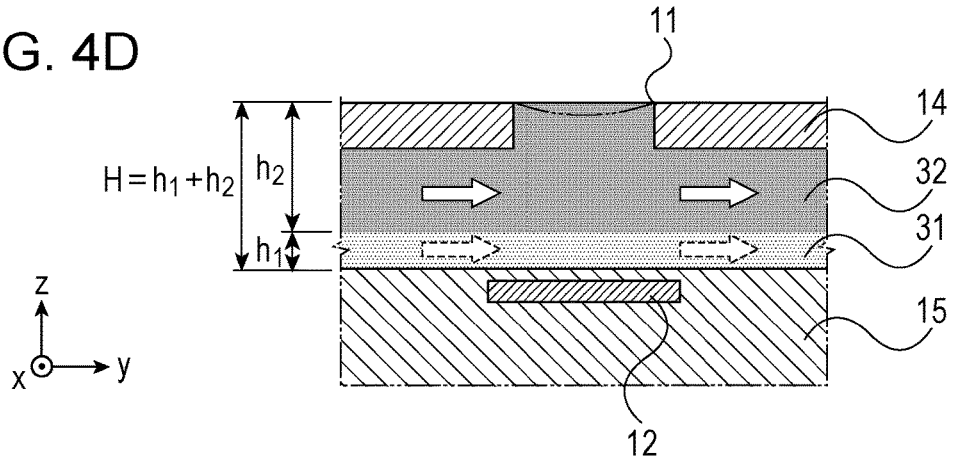

FIG. 4A to FIG. 4D are views for illustrating the detailed configuration of one pair of the liquid channel 13 and the pressure chamber 18, formed on the surface of the substrate 15. FIG. 4A is a see-through view from the discharge port 11 side (+z side). FIG. 4B is a cross-sectional view taken along the line IVb-IVb in FIG. 4A. FIG. 4C is an enlarged view around the one liquid channel 13 in the element substrate 10 shown in FIG. 3. FIG. 4D is an enlarged view around the discharge port 11 in FIG. 4B.

A second inflow channel 21, a first inflow channel 20, a first outflow channel 25, and a second outflow channel 26 are formed in the substrate 15 corresponding to the bottom portion of the liquid channel 13 in this order in the y direction. The pressure chamber 18 that communicates with the discharge port 11 and that contains the pressure generating element 12 is disposed substantially in the middle between the first inflow channel 20 and the first outflow channel 25 in the liquid channel 13. Here, the pressure chamber 18 is a space that contains the pressure generating element 12 inside and that stores liquid to which a pressure generated by the pressure generating element 12 is applied. Or, the pressure chamber 18 is a space inside a circle with a radius a about the pressure generating element 12 where the length from the pressure generating element 12 to the discharge port 11 is defined as a. The second inflow channel 21 connects with the second common supply channel 28, the first inflow channel 20 connects with the first common supply channel 23, the first outflow channel 25 connects with the first common collecting channel 24, and the second outflow channel 26 connects with the second common collecting channel 29 (see FIG. 3).

Based on the above configuration, a first liquid 31 supplied from the first common supply channel 23 to the liquid channel 13 via the first inflow channel 20 flows in the y direction (direction indicated by the arrow), passes through the pressure chamber 18, and is then collected by the first common collecting channel 24 via the first outflow channel 25. Also, a second liquid 32 supplied from the second common supply channel 28 to the liquid channel 13 via the second inflow channel 21 flows in the y direction (direction indicated by the arrow), passes through the pressure chamber 18, and is then collected by the second common collecting channel 29 via the second outflow channel 26. In other words, both the first liquid 31 and the second liquid 32 flow in the y direction between the first inflow channel 20 and the first outflow channel 25 within the liquid channel 13.

In the pressure chamber 18, the pressure generating element 12 is in contact with the first liquid 31, and the second liquid 32 exposed to the atmosphere forms a meniscus near the discharge port 11. In the pressure chamber 18, the first liquid 31 and the second liquid 32 flow such that the pressure generating element 12, the first liquid 31, the second liquid 32, and the discharge port 11 are arranged in this order. In other words, where a side on which the pressure generating element 12 is present is a lower side and a side on which the discharge port 11 is present is an upper side, the second liquid 32 flows on the upper side of the first liquid 31. The first liquid 31 and the second liquid 32 are pressurized by the pressure generating element 12 on the lower side and is discharged from the lower side toward the upper side. This upper and lower direction is the height direction of each of the pressure chamber 18 and the liquid channel 13.

In the present embodiment, the flow rate of the first liquid 31 and the flow rate of the second liquid 32 are adjusted according to the physical properties of the first liquid 31 and the physical properties of the second liquid 32 such that the first liquid 31 and the second liquid 32 flow alongside while being in contact with each other in the pressure chamber 18 as shown in FIG. 4D. In the first embodiment and the second embodiment, the first liquid 31 and the second liquid 32 are caused to flow in the same direction. However, the present disclosure is not limited thereto, the second liquid 32 may flow in a direction opposite to a flow direction of the first liquid 31. Alternatively, channels may be provided such that the flow of the first liquid 31 and the flow of the second liquid 32 are orthogonal to each other. The liquid discharge head 1 is configured such that the second liquid 32 flows on the upper side of the first liquid 31 in the height direction of the liquid channel. However, the present disclosure is not limited thereto, the first liquid 31 and the second liquid 32 each may flow in contact with the bottom face of the liquid channel.

Such a flow of two liquids includes not only a parallel flow in which two liquids flow in the same direction as shown in FIG. 4D but also a counter flow in which a second liquid flows in a direction opposite to a flow direction of a first liquid or a flow of liquids in which the flow of a first liquid and the flow of a second liquid intersect with each other. Hereinafter, of these, parallel flows will be described as an example.

In the case of a parallel flow, it is desirable that the interface between the first liquid 31 and the second liquid 32 not be disrupted, that is, a flow in the pressure chamber 18 through which the first liquid 31 and the second liquid 32 flow is in a laminar flow state. Particularly, when discharge performance is intended to be controlled, for example, a predetermined discharge amount is maintained, it is desirable to drive the pressure generating element 12 in a state where the interface is stable. However, the present disclosure is not limited thereto. Even when a flow in the pressure chamber 18 is a turbulent flow and, as a result, the interface between two liquids is somewhat disrupted, the pressure generating element 12 may be driven as long as the first liquid flows mainly on the pressure generating element 12 side and the second liquid flows mainly on the discharge port 11 side. Hereinafter, an example in which a flow in the pressure chamber is a parallel flow in a laminar flow state will be mainly described.

Forming Condition for Laminar Parallel Flow

Initially, a condition under which liquids form a laminar flow in a pipe will be described. Generally, Reynolds number Re indicating the ratio of interfacial tension to viscous force is known as an index for assessment of a flow.

Where the density of a liquid is ρ, the flow velocity is u, the characteristic length is d, and the viscosity is η, a Reynolds number Re is expressed by the formula 1.

$$Re=\rho ud/\eta \quad (1)$$

Here, it is known that a laminar flow is more likely to be formed as the Reynolds number Re reduces. Specifically, it is known that, for example, a flow in a circular pipe is a laminar flow when the Reynolds number Re is lower than about 2200 and a flow in a circular pipe is a turbulent flow when the Reynolds number Re is higher than about 2200.

The fact that a flow is a laminar flow means that a flow line is parallel to a traveling direction of a flow and does not intersect with the travel direction. Therefore, when two liquids that are in contact with each other each are a laminar flow, a parallel flow in which the interface between the two liquids is stable is formed. Here, considering a general inkjet printing head, a flow channel height (pressure chamber height) H [μm] around a discharge port in a liquid channel is about 10 μm to about 100 μm. Thus, when water (density $\rho=1.0\times10^3$ kg/m$^3$, viscosity $\eta=1.0$ cP) is caused to flow through the liquid channel of the inkjet printing head at a flow velocity of 100 mm/s, the Reynolds number $Re=\rho ud/\eta\approx0.1$ to $1.0<<<2200$, so it may be regarded that a laminar flow is formed.

As shown in FIG. 4A to FIG. 4D, even when the cross section of the liquid channel 13 or the pressure chamber 18 is rectangular, the height or width of the liquid channel 13 or the pressure chamber 18 is sufficiently small in the liquid discharge head. Therefore, the liquid channel 13 or the pressure chamber 18 may be regarded equivalently to those of a circular pipe, that is, the effective diameter of the liquid channel 13 or the pressure chamber 18 may be regarded as the diameter of a circular pipe.

Theoretical Forming Condition for Laminar Parallel Flow

Next, a condition for forming a parallel flow in which the interface between liquids of two types is stable in the liquid channel 13 and the pressure chamber 18 will be described with reference to FIG. 4D. Initially, a distance from the substrate 15 to the discharge port surface of the orifice plate 14 is defined as H [μm]. A distance from the discharge port surface to the liquid-to-liquid interface between the first liquid 31 and the second liquid 32 (the phase thickness of the second liquid) is defined as $h_2$ [μm]. A distance from the liquid-to-liquid interface to the substrate 15 (the phase thickness of the first liquid) is defined as $h_1$ [μm]. In other words, $H=h_1+h_2$.

Here, the velocity of liquid on the walls of the liquid channel 13 and pressure chamber 18 is zero as a boundary condition in the liquid channel 13 and the pressure chamber 18. It is also assumed that the velocity and shearing stress at the liquid-to-liquid interface between the first liquid 31 and the second liquid 32 have continuity. On this assumption, when it is assumed that the first liquid 31 and the second liquid 32 form two-layer parallel steady flows, the quartic equation shown in the equation 2 holds in a parallel flow section.

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad (2)$$

In the equation 2, $\eta_1$ denotes the viscosity of the first liquid 31, $\eta_2$ denotes the viscosity of the second liquid 32, $Q_1$ denotes the flow rate of the first liquid 31, and $Q_2$ denotes the flow rate of the second liquid 32. In other words, within the range in which the quartic equation 2 holds, the first liquid and the second liquid flow so as to achieve a positional relationship according to their flow rates and viscosities, and a parallel flow with a stable interface is formed. In the present embodiment, it is desirable that a parallel flow of the first liquid and the second liquid be formed in the liquid channel 13, and at least in the pressure chamber 18. When such a parallel flow is formed, the first liquid and the second liquid only mix through molecular diffusion at their liquid-to-liquid interface and flow parallel in the y direction without substantially mixing with each other. In the present embodiment, the flow of liquids in all of the pressure chamber 18 does not need to be in a laminar flow state. It is desirable that the flow of liquids flowing through at least the region on the pressure generating element 12 be in a laminar flow state.

Even when, for example, immiscible solvents like water and oil are used as a first liquid and a second liquid, but the equation 2 is satisfied, a parallel flow is formed regardless of the fact that both are immiscible. Even in the case of water and oil, it is desirable that, even when a flow in the pressure chamber is somewhat in a turbulent flow state and the interface is disrupted as described above, at least mostly the first liquid flow on the pressure generating element and mostly the second liquid flow through the discharge port.

Figure 5A:
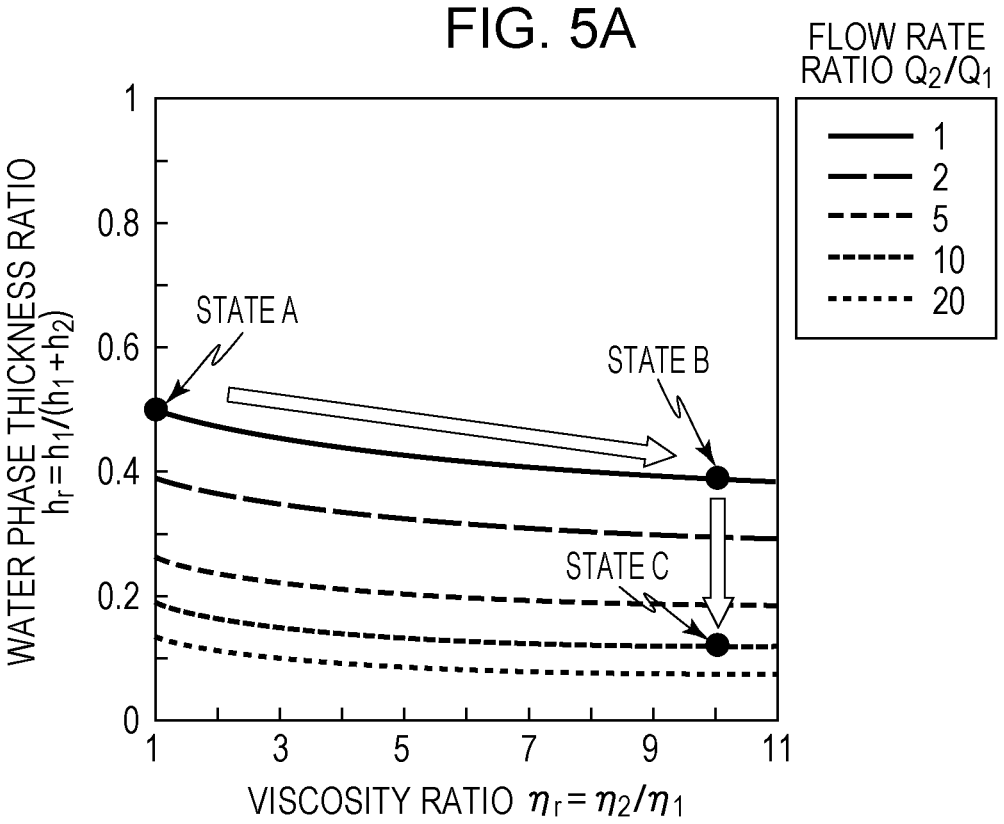
FIG. 5A is a graph showing the relationship between viscosity ratio and water phase thickness ratio.

FIG. 5A is a graph showing the relationship between viscosity ratio $\eta_r=\eta_2/\eta_1$ and the phase thickness ratio $h_r=h_1/(h_1+h_2)$ of the first liquid for multiple different flow rate ratios $Q_r=Q_2/Q_1$. The first liquid is not limited to water, and, hereinafter, the "phase thickness ratio of the first liquid" is referred to as "water phase thickness ratio". The abscissa axis represents viscosity ratio $\eta_r=\eta_2/\eta_1$, and the ordinate axis represents water phase thickness ratio $h_r=h_1/(h_1+h_2)$. As the flow rate ratio $Q_r$ increases, the water phase thickness ratio $h_r$ reduces. For any flow rate ratio $Q_r$ as well, as the viscosity ratio $\eta_r$ increases, the water phase thickness ratio $h_r$ reduces. In other words, the water phase thickness ratio $h_r$ (the interface position between the first liquid and the second liquid) in the pressure chamber 18 can be adjusted to a predetermined value by controlling the viscosity ratio $\eta_r$ and the flow rate ratio $Q_r$ between the first liquid and the second liquid. Then, according to FIG. 5A, it is found that, when the viscosity ratio $\eta_r$ and the flow rate ratio $Q_r$ are compared with each other, the flow rate ratio $Q_r$ has a greater influence on the water phase thickness ratio $h_r$ than the viscosity ratio $\eta_r$.

For the water phase thickness ratio $h_r=h_1/(h_1+h_2)$, when $0<h_r<1$ (Condition 1) is satisfied, a parallel flow of the first liquid and the second liquid is formed. However, as will be described later, in the present embodiment, the first liquid is mainly caused to function as a bubbling medium and the second liquid is mainly caused to function as a discharge medium, and the first liquid and the second liquid included in discharge liquid droplets are stabilized at a desired ratio. When such a situation is considered, the water phase thickness ratio $h_r$ is preferably lower than or equal to 0.8 (Condition 2) and is more preferably lower than or equal to 0.5 (Condition 3).

Here, the state A, the state B, and the state C, shown in FIG. 5A, respectively indicate the following states.

Figure 5B:
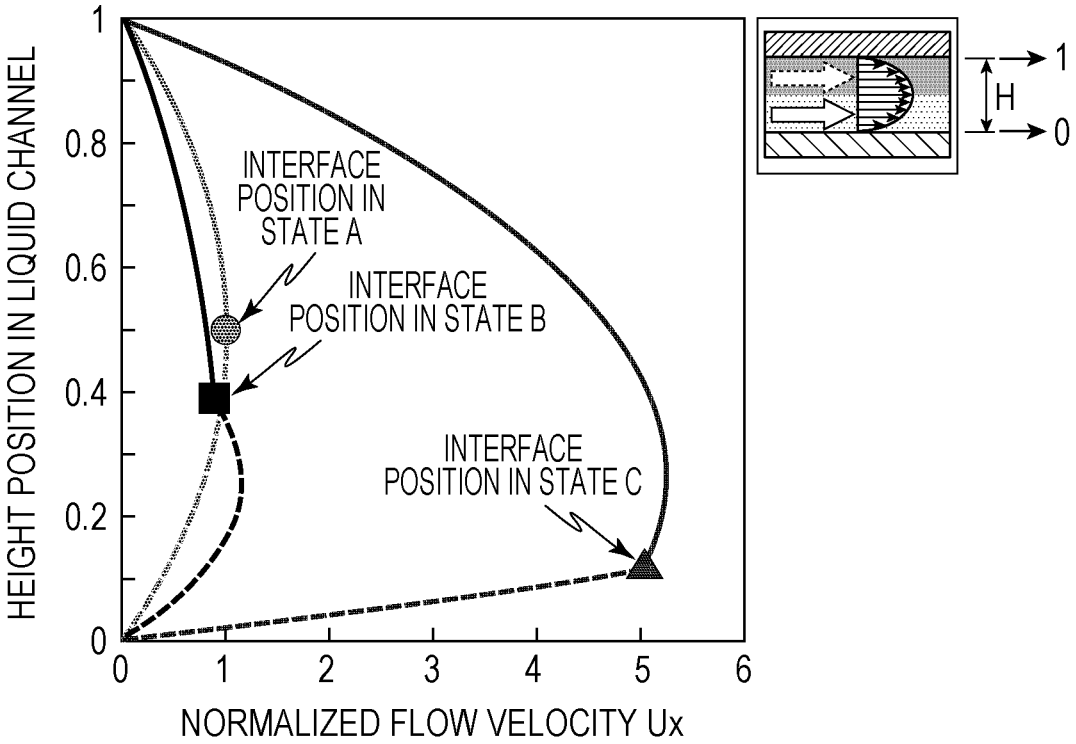
FIG. 5B is a graph showing the relationship between the height of a channel and flow velocity.

State A) Water phase thickness ratio $h_r=0.50$ in the case where viscosity ratio $\eta_r=1$ and flow rate ratio $Q_r=1$ State B) Water phase thickness ratio $h_r=0.39$ in the case where viscosity ratio $\eta_r=10$ and flow rate ratio $Q_r=1$ State C) Water phase thickness ratio $h_r=0.12$ in the case where viscosity ratio $\eta_r=10$ and flow rate ratio $Q_r=10$ FIG. 5B is a graph showing a flow velocity distribution in the height direction (z direction) of the liquid channel 13 for each of the states A, B, and C. The abscissa axis represents normalized value Ux obtained through normalization where a flow velocity maximum value in the state A is 1 (reference). The ordinate axis represents height from a bottom face where the height H of the liquid channel 13 is 1 (reference). In curves representing the states, the interface positions between the first liquid and the second liquid are indicated by markers. It is found that the interface position changes with the state, for example, the interface position of the state A is higher than the interface position of the state B or the state C. This is because, when liquids of two types having different viscosities each are a laminar flow (laminar flow as a whole) and flow parallel in a pipe, the interface between these two liquids is formed at a position where a pressure difference due to the difference in viscosity between these liquids and a Laplace pressure due to interfacial tension balance out.

Relationship Between Flow Rate Ratio and Water Phase Thickness Ratio

Figure 6:
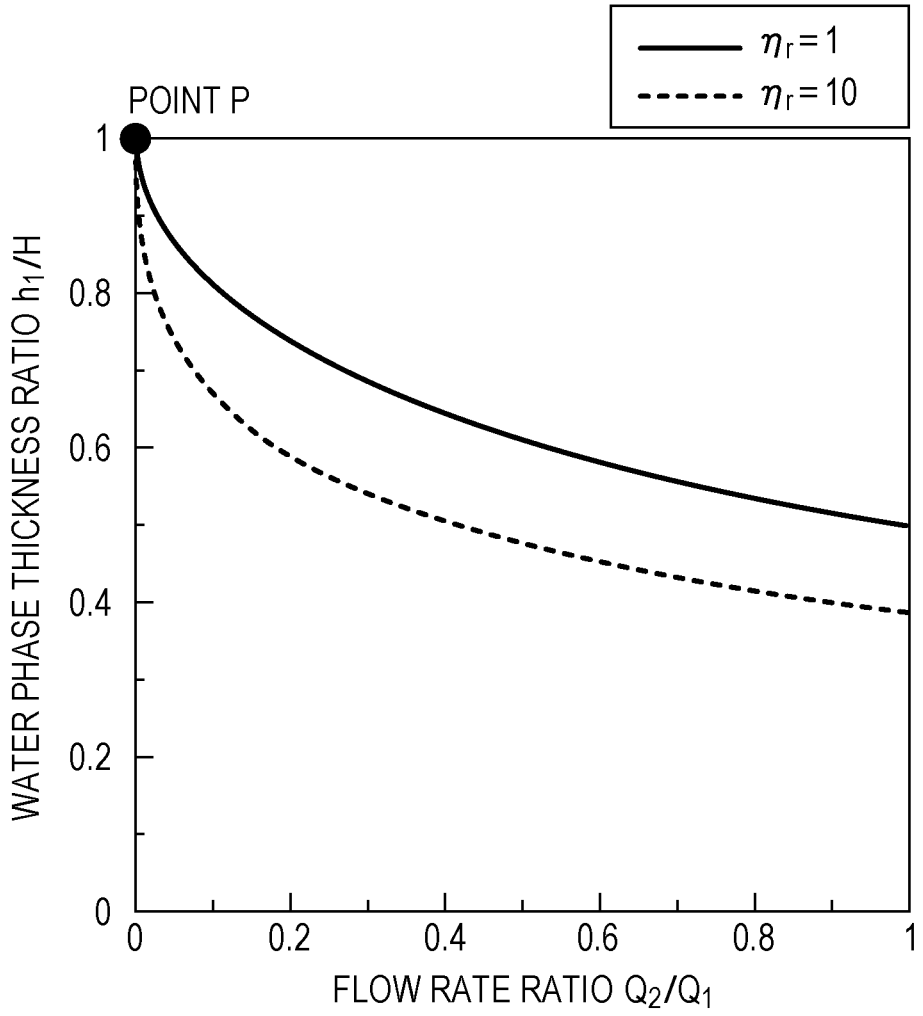
FIG. 6 is a graph showing the relationship between flow rate ratio and water phase thickness ratio.

FIG. 6 is a graph showing the relationship between flow rate ratio $Q_r$ and water phase thickness ratio $h_r$ for the case where the viscosity ratio $\eta_r=1$ and the case where the viscosity ratio $\eta_r=10$ by using the equation 2. The abscissa axis represents flow rate ratio $Q_r=Q_2/Q_1$, and the ordinate axis represents water phase thickness ratio $h_r=h_1/(h_1+h_2)$. The flow rate ratio $Q_r=0$ corresponds to the case where $Q_2=0$, the liquid channel is filled with only the first liquid, no second liquid is present, and the water phase thickness ratio $h_r=1$. The point P in the graph indicates this state.

As $Q_r$ is increased from the position of the point P (that is, the flow rate $Q_2$ of the second liquid is increased from zero), the water phase thickness ratio $h_r$, that is, the water phase thickness $h_1$ of the first liquid, reduces, and the water phase thickness $h_2$ of the second liquid increases. In other words, the state shifts from the state where only the first liquid flows to the state where the first liquid and the second liquid flow parallel via the interface. Such a tendency is similarly ensured not only in the case where the viscosity ratio between the first liquid and the second liquid is $\eta_r=1$ but also in the case where the viscosity ratio $\eta_r=10$.

In other words, to achieve a state where the first liquid and the second liquid flow alongside via the interface in the liquid channel 13, $Q_r=Q_2/Q_1>0$, that is, $Q_1>0$ and $Q_2>0$, need to be satisfied. This means that the first liquid and the second liquid both flow in the same y direction.

Transient State of Discharge Operation

Next, a transient state of discharge operation in the liquid channel 13 and the pressure chamber 18, in which a parallel flow is formed, will be described. FIG. 7A to FIG. 7E are diagrams schematically showing a transient state in the case where discharge operation is performed in a state where the first liquid and the second liquid at the viscosity ratio $\eta_r=4$ form a parallel flow. In FIG. 7A to FIG. 7E, the height H of the pressure chamber 18 is H [μm]=20 μm, and the thickness T of the orifice plate 14 is T [μm]=6 μm.

Figures 7A, 7B, 7C, 7D, 7E:
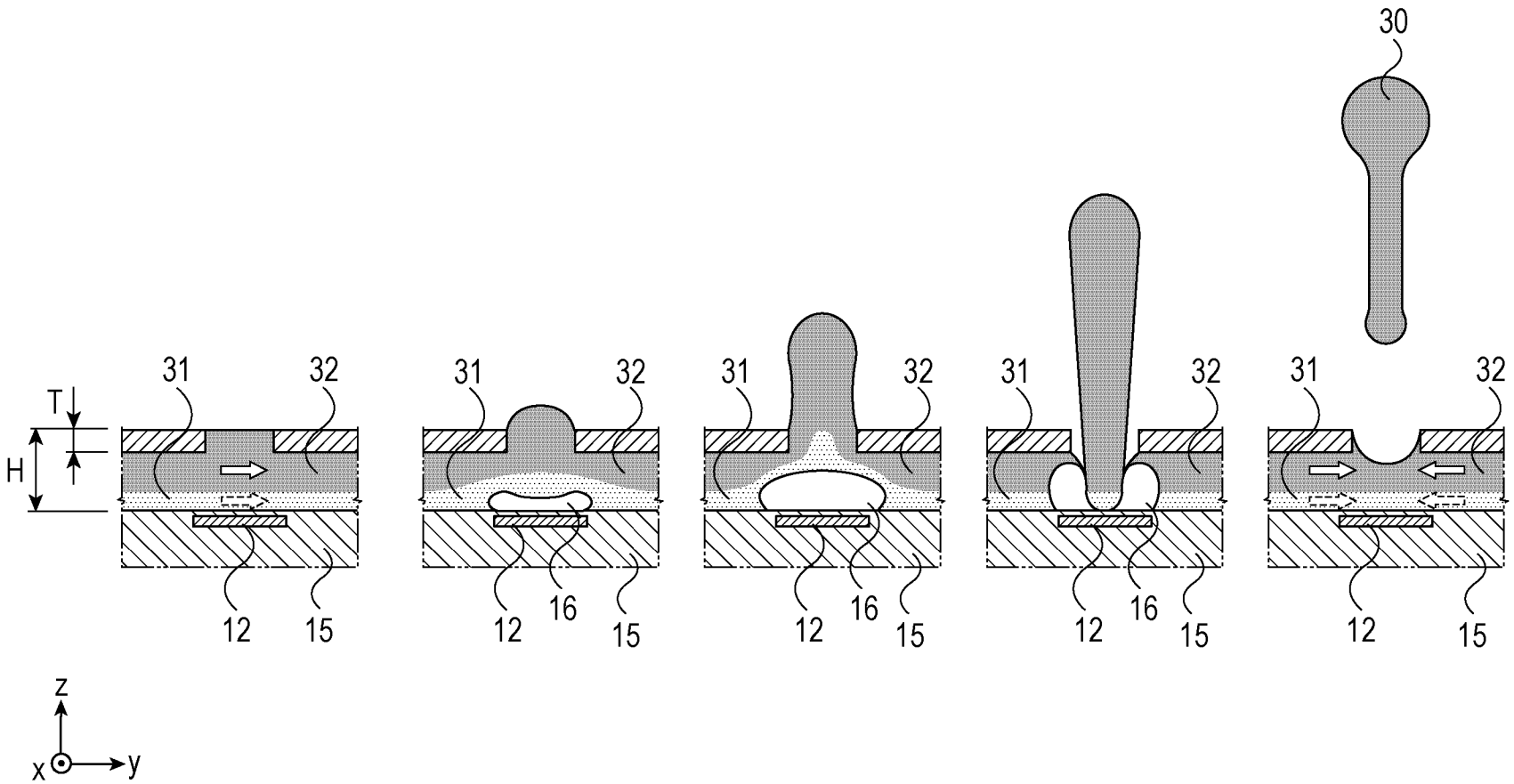
FIG. 7A to FIG. 7E are diagrams schematically showing a transient state of discharge operation.
Figures 8A, 8B, 8C, 8D, 8E, 8F, 8G:
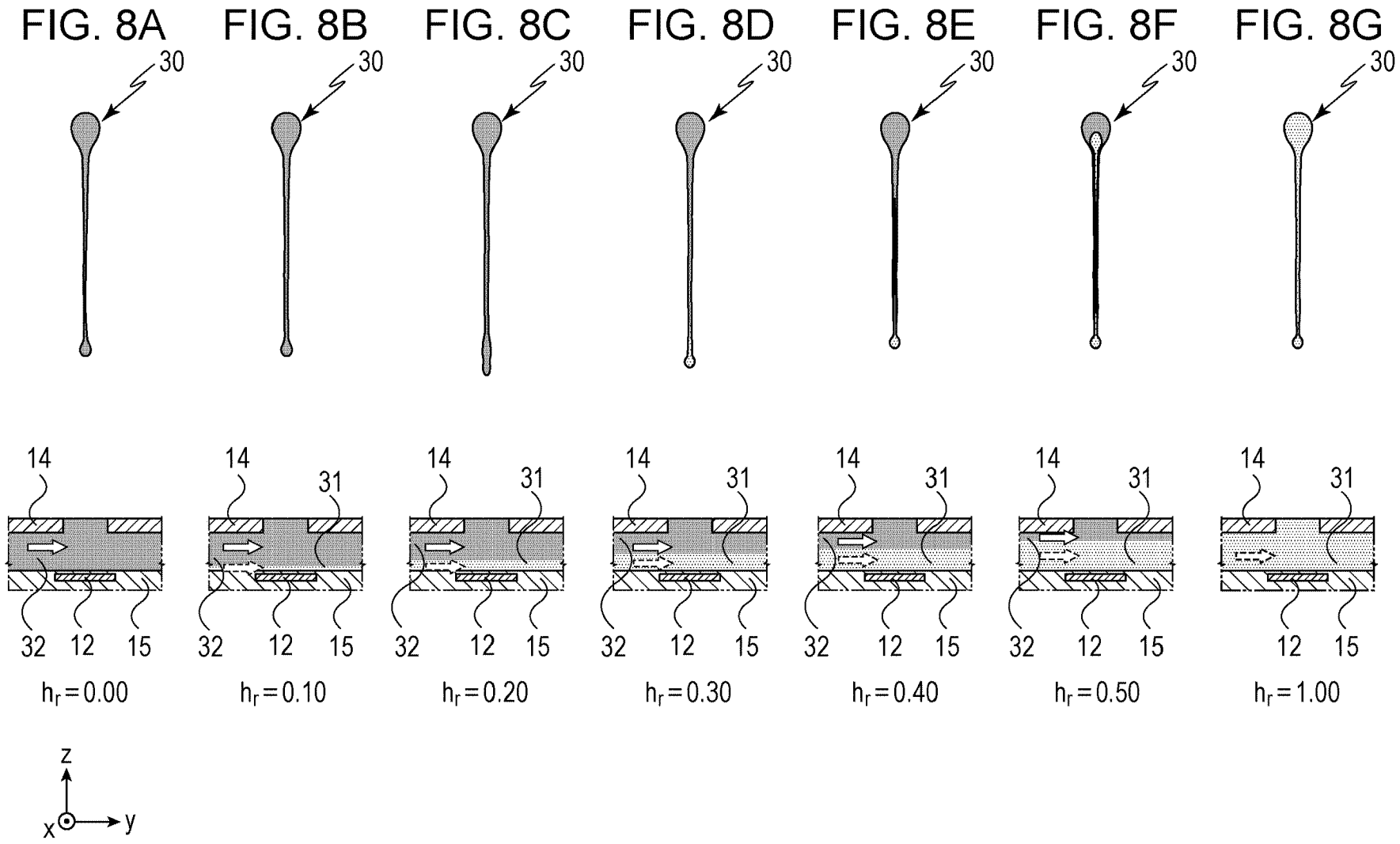
FIG. 8A to FIG. 8G are diagrams showing discharge liquid droplets for various water phase thickness ratios.
Figures 9A, 9B, 9C, 9D, 9E:
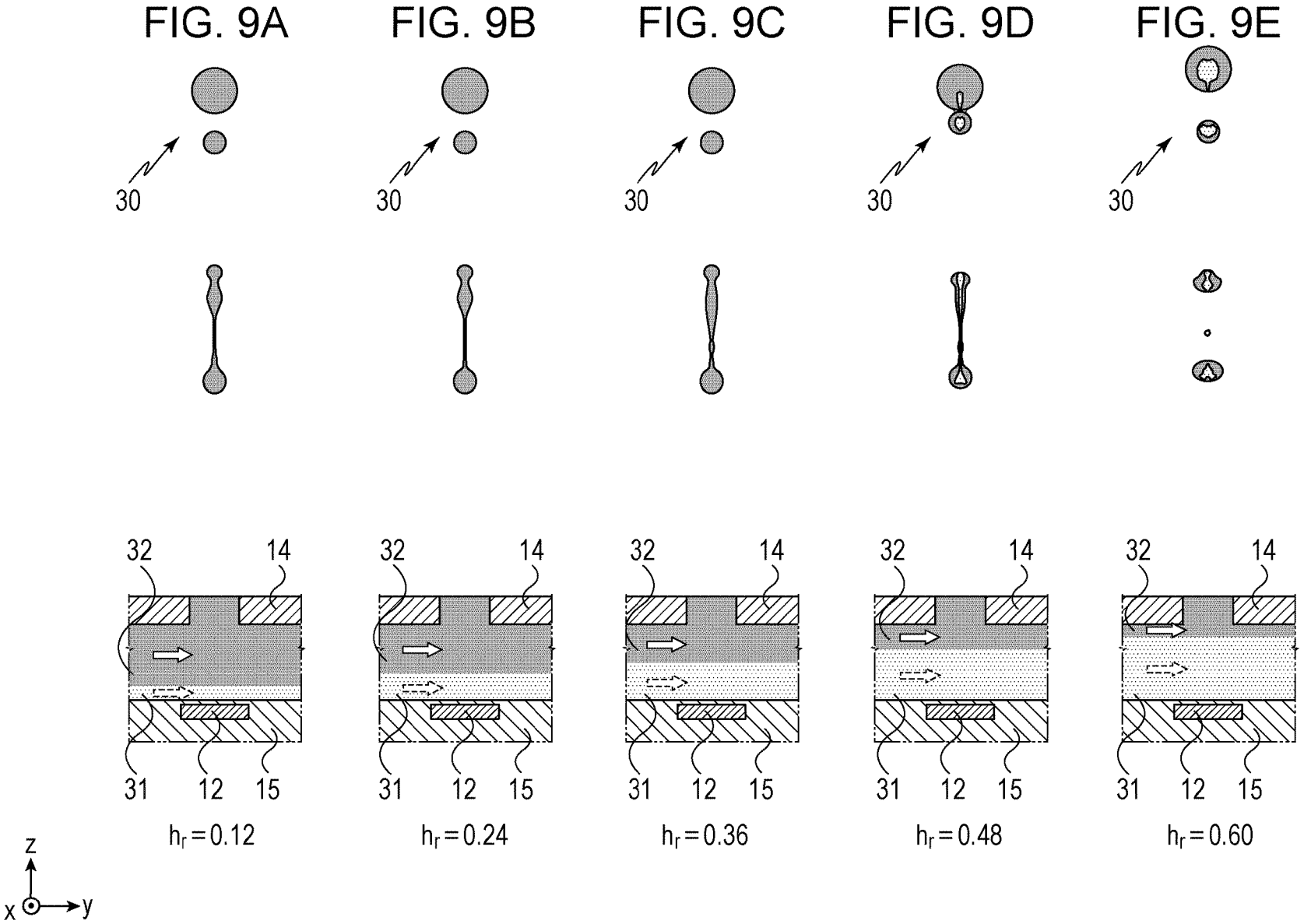
FIG. 9A to FIG. 9E are diagrams showing discharge liquid droplets for various water phase thickness ratios.

FIG. 7A shows a state before a voltage is applied to the pressure generating element 12. Here, FIG. 7A shows a state where the interface position is stabilized at a position where the water phase thickness ratio $\eta_r=0.57$ (that is, the water phase thickness $h_1$ [μm] of the first liquid=6 μm) by adjusting $Q_1$ and $Q_2$ of the first liquid and second liquid flowing together.

FIG. 7B shows a state where a voltage begins to be applied to the pressure generating element 12. The pressure generating element 12 of the present embodiment is an electrothermal converter (heater). In other words, the pressure generating element 12 rapidly generates heat when applied with a voltage pulse according to a discharge signal to cause film boiling to occur in the first liquid with which the pressure generating element 12 contacts. In the diagram, a state where a bubble 16 is generated by film boiling is shown. By the amount by which the bubble 16 is generated, the interface between the first liquid 31 and the second liquid 32 moves in the z direction (the height direction of the pressure chamber), and the second liquid 32 is pushed out in the z direction beyond the discharge port 11.

FIG. 7C shows a state where the volume of the bubble 16 generated by film boiling has increased and the second liquid 32 is further pushed out in the z direction beyond the discharge port 11.

FIG. 7D shows a state where the bubble 16 communicates with the atmosphere. In the present embodiment, at the shrinkage stage after the maximum growth of the bubble 16, a gas-liquid interface moved from the discharge port 11 to the pressure generating element 12 side communicates with the bubble 16.

FIG. 7E shows a state where a liquid droplet 30 has been discharged. A liquid already projected beyond the discharge port 11 at the timing when the bubble 16 communicates with the atmosphere as shown in FIG. 7D leaves from the liquid channel 13 under the inertial force and ejects in the z direction in the form of the liquid droplet 30. On the other hand, in the liquid channel 13, the amount of liquid consumed as a result of the discharge is supplied from both sides of the discharge port 11 by the capillary force of the liquid channel 13, and a meniscus is formed again in the discharge port 11. A parallel flow of the first liquid and the second liquid flowing in the y direction is formed again as shown in FIG. 7A.

In this way, in the present embodiment, discharge operation shown in FIG. 7A to FIG. 7E is performed in a state where the first liquid and the second liquid are flowing as a parallel flow. This description will be specifically made again with reference to FIG. 2. The CPU 500 uses the liquid circulation unit 504 to circulate the first liquid and the second liquid in the discharge head 1 while maintaining the constant flow rate of the first liquid and the constant flow rate of the second liquid. While the CPU 500 continues such control, the CPU 500 applies voltages in accordance with discharge data to the individual pressure generating elements 12 disposed in the discharge head 1. Depending on the amount of liquid discharged, the flow rate of the first liquid and the flow rate of the second liquid may not always be constant.

When discharge operation is performed in a state where liquids are flowing, there may be concerns that the flow of the liquids influences discharge performance. However, in a general inkjet printing head, the liquid droplet discharge velocity is in the order of several meters per second to several tens of meters per second and by far higher than the flow velocity in the liquid channel by orders of several millimeters per second to several meters per second. Thus, even when the discharge operation is performed in a state where the first liquid and the second liquid flow at several millimeters per second to several meters per second, discharge performance is less likely to come under the influence of such discharge operation.

In the present embodiment, the configuration in which the bubble 16 and the atmosphere communicate in the pressure chamber 18 is described; however, the present disclosure is not limited thereto. For example, the bubble 16 may communicate with the atmosphere outside the discharge port 11 (on the atmosphere side) or the bubble 16 may disappear without communicating with the atmosphere.

Rate of Liquid in Discharge Liquid Droplet

FIG. 8A to FIG. 8G are diagrams for comparing discharge liquid droplets in the case where the water phase thickness ratio $h_r$ is changed in a stepwise manner in the pressure chamber 18 of which the pressure chamber 18 height is H [μm]=20 μm. The water phase thickness ratio $h_r$ is increased in the increments of 0.10 from FIG. 8A to FIG. 8F, and the water phase thickness ratio $h_r$ is increased in the increments of 0.50 from FIG. 8F to FIG. 8G. Discharge liquid droplets in FIG. 8A to FIG. 8G are shown in accordance with the results obtained through simulations performed under the conditions that the viscosity of the first liquid is 1 cP, the viscosity of the second liquid is 8 cP, and the liquid droplet discharge velocity is 11 m/s.

As shown in FIG. 4D, the water phase thickness hi of the first liquid 31 reduces as the water phase thickness ratio $h_r$ ($=h_1/(h_1+h_2)$) approaches zero, and the water phase thickness $h_1$ of the first liquid 31 increases as the water phase thickness ratio $h_r$ approaches one. For this reason, a liquid mainly contained in the discharge liquid droplet 30 is the second liquid 32 closer to the discharge port 11; however, as the water phase thickness ratio $h_r$ approaches one, the rate of the first liquid 31 contained in the discharge liquid droplet 30 also increases.

In the case of FIG. 8A to FIG. 8G in which the pressure chamber 18 height is H [μm]=20 μm, only the second liquid 32 is included in the discharge liquid droplet 30 and no first liquid 31 is included in the discharge liquid droplet 30 at the water phase thickness ratio $h_r$=0.00, 0.10, or 0.20. However, the first liquid 31 is also included in the discharge liquid droplet 30 together with the second liquid 32 at the water phase thickness ratio $h_r$=0.30 or higher, and only the first liquid 31 is included in the discharge liquid droplet 30 at the water phase thickness ratio $h_r$=1.00 (that is, a state where no second liquid is present). In this way, the ratio between the first liquid and the second liquid, included in the discharge liquid droplet 30, varies with the water phase thickness ratio $h_r$ in the liquid channel 13.

On the other hand, FIG. 9A to FIG. 9E are diagrams for comparing discharge liquid droplets 30 in the case where the water phase thickness ratio $h_r$ is changed in a stepwise manner in the liquid channel 13 of which the pressure chamber 18 height is H [μm]=33 μm. In this case, only the second liquid 32 is included in the discharge liquid droplet 30 in the range of the water phase thickness ratio up to $h_r$=0.36, and the first liquid 31 is also included in the discharge liquid droplet 30 together with the second liquid 32 in the range of the water phase thickness ratio from $h_r$=0.48.

Figure 10A:
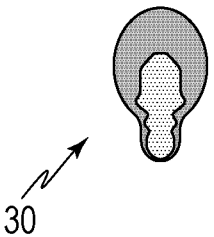
FIG. 10A to FIG. 10C are diagrams showing discharge liquid droplets for various water phase thickness ratios.
Figure 10A:
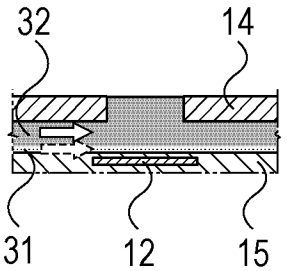
Figure 10B:
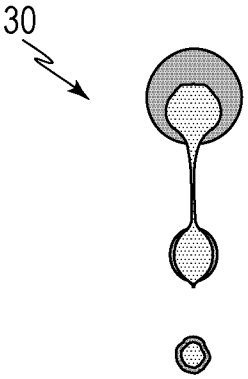
Figure 10B:
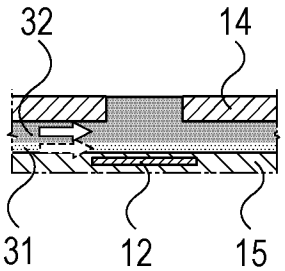
Figure 10C:
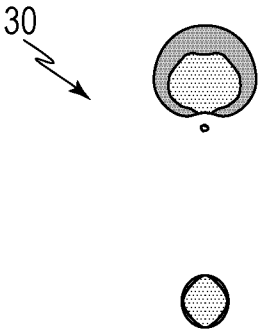
Figure 10C:
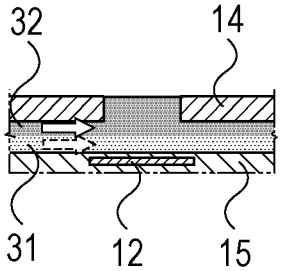
Figure 10C:
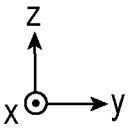

FIG. 10A to FIG. 10C are diagrams for comparing discharge liquid droplets 30 in the case where the water phase thickness ratio $h_r$ is changed in a stepwise manner in the liquid channel 13 of which the pressure chamber 18 height is H [μm]=10 μm. In this case, even when the water phase thickness ratio is $h_r$=0.10, the first liquid 31 is included in the discharge liquid droplet 30.

Figure 11:
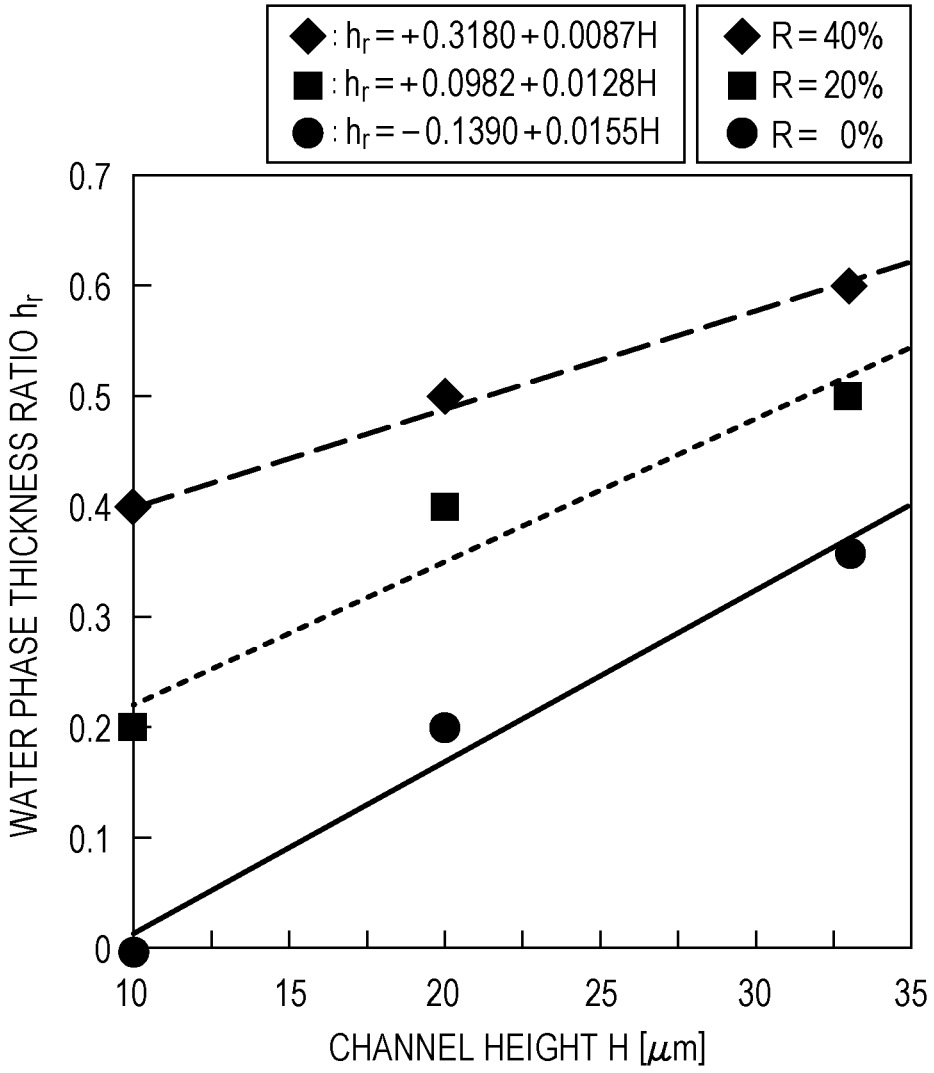
FIG. 11 is a graph showing the relationship between the height of a channel (pressure chamber) and water phase thickness ratio.

FIG. 11 is a graph showing the relationship between channel (pressure chamber) height H and water phase thickness ratio $h_r$ in the case of a fixed rate R at which the first liquid 31 is included in the discharge liquid droplet 30 where the rate R is set to 0%, 20%, or 40%. At any rate R, as the channel height H increases, the desired water phase thickness ratio $h_r$ also increases. Here, a rate R at which the first liquid 31 is included means a rate at which a liquid flowing as the first liquid 31 in the liquid channel 13 is included in a discharge liquid droplet. Thus, even when each of the first liquid and the second liquid contains the same ingredient like, for example, water, water contained in the second liquid is, of course, not reflected in the rate.

When only the second liquid 32 is included in the discharge liquid droplet 30 and no first liquid is included in the discharge liquid droplet 30 (R=0%), the relationship between channel height H [μm] and water phase thickness ratio $h_r$ takes the locus represented by the continuous line in the graph. According to the study of the present inventors, a water phase thickness ratio $h_r$ can be approximated as a linear function of channel height H [μm], expressed by the equation 3.

$$h_r=-0.1390+0.0155H \quad (3)$$

When 20% first liquid is intended to be included in the discharge liquid droplet 30 (R≤20%), the water phase thickness ratio $h_r$ can be approximated as a linear function of channel height H [μm], expressed by the equation 4.

$$h_r=+0.0982+0.0128H \quad (4)$$

Furthermore, when 40% first liquid is intended to be included in the discharge liquid droplet 30 (R=40%), the water phase thickness ratio $h_r$ can be approximated as a linear function of channel height H [μm], expressed by the equation 5, according to the study of the present inventors.

$$h_r=+0.3180+0.0087H \quad (5)$$

When, for example, no first liquid is intended to be included in the discharge liquid droplet 30, the water phase thickness ratio $h_r$ needs to be adjusted to 0.20 or lower when the channel height H [μm] is 20 μm. The water phase thickness ratio $h_r$ needs to be adjusted to 0.36 or lower when the channel height H [μm] is 33 μm. Furthermore, the water phase thickness ratio $h_r$ needs to be adjusted to substantially zero (0.00) when the channel height H [μm] is 10 μm.

However, when the water phase thickness ratio $h_r$ is reduced too much, the viscosity $\eta_2$ and flow rate $Q_2$ of the second liquid relative to the first liquid need to be increased, so there are concerns about inconvenience resulting from an increase in pressure loss. For example, referring to FIG. 5A again, when the water phase thickness ratio $h_r$=0.20 is achieved, the flow rate ratio $Q_r$=5 for the viscosity ratio $h_r$=10. If the water phase thickness ratio $h_r$ is set to 0.10 in order to obtain reliability of not discharging the first liquid while using the same inks (that is, the same viscosity ratio $\eta_r$), the flow rate ratio $Q_r$=15. In other words, when the water phase thickness ratio $h_r$ is adjusted to 0.10, the flow rate ratio $Q_r$ needs to be increased to three times as compared to the case where the water phase thickness ratio $h_r$ is adjusted to 0.20, so there are concerns about an increase in pressure loss and accompanying inconvenience.

From above, when only the second liquid 32 is intended to be discharged while pressure loss is minimized, it is desirable that the water phase thickness ratio $h_r$ be set to a large value as much as possible under the above conditions. When specifically described with reference to FIG. 11 again, it is desirable that the water phase thickness ratio $h_r$ be less than 0.20 and adjusted to a value close to 0.20 as much as possible when, for example, the channel height is H [μm]=20 μm. When the channel height is H [μm]=33 μm, it is desirable that the water phase thickness ratio $h_r$ be less than 0.36 and adjusted to a value close to 0.36 as much as possible.

The above-described equations 3, 4, and 5 are numeric values in a general liquid discharge head, that is, a liquid discharge head of which the discharge velocity of discharge liquid droplets falls within the range of 10 m/s to 18 m/s. Also, the equations 3, 4, and 5 are numeric values on the assumption that the pressure generating element and the discharge port are located so as to face each other and the first liquid and the second liquid flow such that the pressure generating element, the first liquid, the second liquid, and the discharge port are arranged in this order in the pressure chamber.

In this way, according to the present embodiment, it is possible to stably perform discharge operation of liquid droplets in which the first liquid and the second liquid are included at a constant ratio, by stabilizing the interface with the water phase thickness ratio $h_r$ in the pressure chamber 18, set to a predetermined value.

Incidentally, in order to repeatedly perform the above-described discharge operation in a stable state, it is desired to stabilize the interface position regardless of the frequency of discharge operation while achieving the intended water phase thickness ratio $h_r$.

Here, a specific method for achieving such a state will be described with reference to FIG. 4A to FIG. 4C again. For example, to adjust the flow rate $Q_1$ of the first liquid in the pressure chamber 18, a first pressure difference generation mechanism in which the pressure in the first outflow channel 25 is lower than the pressure in the first inflow channel 20 just needs to be prepared. With this configuration, the flow of the first liquid 31 from the first inflow channel 20 toward the first outflow channel 25 (y direction) is generated. In addition, a second pressure difference generation mechanism in which the pressure in the second outflow channel 26 is lower than the pressure in the second inflow channel 21 just needs to be prepared. With this configuration, the flow of the second liquid 32 from the second inflow channel 21 toward the second outflow channel 26 (y direction) is generated.

Then, in a state where the first pressure difference generation mechanism and the second pressure difference generation mechanism are controlled in a state where the relationship of the equation 6 is maintained in order not to generate backflow in the liquid channel, a parallel flow of the first liquid and the second liquid, which flow in the y direction at a desired water phase thickness ratio $h_r$ in the liquid channel 13, can be formed.

$$P2\text{in} \geq P1\text{in} > P1\text{out} \geq P2\text{out} \quad (6)$$

Here, P1in denotes the pressure in the first inflow channel 20, P1out denotes the pressure in the first outflow channel 25, P2in denotes the pressure in the second inflow channel 21, and P2out denotes the pressure in the second outflow channel 26. In this way, when it is possible to maintain a predetermined water phase thickness ratio $h_r$ in the pressure chamber by controlling the first and second pressure difference generation mechanisms, a suitable parallel flow is recovered in a short time and the next discharge operation is immediately started even when the interface position is disrupted as a result of discharge operation.

Specific Example of First Liquid and Second Liquid

With the configuration of the above-described present embodiment, the first liquid is a bubbling medium for causing film boiling to occur and the second liquid is a discharge medium to be discharged from the discharge port to the outside, so functions desired for the respective liquids are clear. With the configuration of the present embodiment, the flexibility of ingredients to be contained in the first liquid and the second liquid is increased as compared to the existing art. Hereinafter, the configured bubbling medium (first liquid) and discharge medium (second liquid) will be described in detail by way of a specific example.

The bubbling medium (first liquid) of the present embodiment is desired to cause film boiling to occur in the bubbling medium at the time when the electrothermal converter generates heat and, as a result, the generated bubble rapidly increases, that is, to have a high critical pressure capable of efficiently converting thermal energy to bubbling energy. Water is suitable as such a medium. Water has a high boiling point (100° C.) and a high surface tension (58.85 dyne/cm at 100° C.) although the molecular weight is 18 and small, and has a high critical pressure of about 22 MPa. In other words, a bubbling pressure at the time of film boiling is also exceedingly high. Generally, in an ink jet printing apparatus discharging ink by using film boiling, ink in which a color material, such as dye and pigment, is contained in water is suitably used.

However, a bubbling medium is not limited to water. When the critical pressure is higher than or equal to 2 MPa (preferably, higher than or equal to 5 MPa), other mediums are capable of serving the function as a bubbling medium. Examples of the bubbling medium other than water include methyl alcohol and ethyl alcohol, and a mixture of any one or both of these liquids with water may also be used as a bubbling medium. A liquid containing the above-described color material, such as dye and pigment, other additives, or the like in water may also be used.

On the other hand, the discharge medium (second liquid) of the present embodiment does not need physical properties for causing film boiling to occur unlike the bubbling medium. When kogation adheres onto the electrothermal converter (heater), there are concerns that the smoothness of the heater surface is impaired or the thermal conductivity decreases to cause a decrease in bubbling efficiency; however, the discharge medium does not directly contact with the heater, so ingredients contained in the discharge medium are less likely to become charred. In other words, in the discharge medium of the present embodiment, physical property conditions for generating film boiling or avoiding kogation are reduced as compared to ink for an existing thermal head, the flexibility of ingredients contained increases, with the result that the discharge medium can further actively contain ingredients appropriate for uses after being discharged.

For example, pigments not used in the existing art for the reason that the pigments easily become charred on the heater can be actively contained in the discharge medium in the present embodiment. Liquids other than aqueous inks having an exceedingly small critical pressure may also be used as the discharge medium in the present embodiment. Furthermore, various inks having special functions, which have been difficult for the existing thermal head to support, such as an ultraviolet curable ink, a conductive ink, an EB (electron beam) curable ink, a magnetic ink, and a solid ink, can be used as the discharge medium. When blood, cells in a culture solution, or the like is used as a discharge medium, the liquid discharge head of the present embodiment may be used for various uses other than image formation. It is also effective for uses of fabrication of biochips, printing of electronic circuits, and the like.

Particularly, a mode in which the first liquid (bubbling medium) is water or a liquid similar to water and the second liquid (discharge medium) is a pigment ink having a greater viscosity than water, and then, only the second liquid is discharged, is one of the effective uses of the present embodiment. In such a case, as shown in FIG. 5A, it is effective that the water phase thickness ratio $h_r$ is suppressed by minimizing the flow rate ratio $Q_r=Q_2/Q_1$. The second liquid is not limited, so the same liquids as listed for the first liquid may be used. Even when, for example, two liquids each are an ink containing a large amount of water, one of the inks may be used as the first liquid and the other one of the inks may be used as the second liquid according to the situation, for example, a mode of use.

Ultraviolet Curable Ink as One Example of Discharge Medium

An ingredient composition of an ultraviolet curable ink usable as the discharge medium of the present embodiment will be described as an example. Ultraviolet curable inks are classified into 100% solid inks made of a polymerizable reactive ingredient without containing a solvent and solvent inks containing water or a solvent as a diluent. Ultraviolet curable inks widely used in recent years are 100% solid ultraviolet curable inks made of a nonaqueous photopolymerizable reactive ingredient (monomer or oligomer) without containing a solvent. The composition includes a monomer as a main ingredient and includes a small amount of other additives such as a photopolymerization initiator, a color material, a dispersant, and a surfactant. The ratio among the monomer, the photopolymerization initiator, the color material, and the other additives is about 80 to 90 wt %:5 to 10 wt %:2 to 5 wt %:remainder. In this way, for even ultraviolet curable inks that have been difficult for the existing thermal head to support, when the ultraviolet curable inks are used as the discharge medium of the present embodiment, the ultraviolet curable inks can be discharged from the liquid discharge head through stable discharge operation. Thus, it is possible to print images more excellent in image fastness and scratch resistance than the existing art.

Example in which Discharge Liquid Droplet is Mixed Solution

Next, the case where the discharge liquid droplet 30 in which the first liquid 31 and the second liquid 32 are mixed at a predetermined ratio is discharged will be described. For example, in the case where the first liquid 31 and the second liquid 32 are different color inks, when the relation in which the Reynolds number calculated by using the viscosities and flow rates of both liquids is lower than a predetermined value is satisfied, these inks form a laminar flow without mixing with each other in the liquid channel 13 and the pressure chamber 18. In other words, by controlling the flow rate ratio $Q_r$ between the first liquid 31 and the second liquid 32 in the liquid channel 13 and the pressure chamber 18, the water phase thickness ratio $h_r$, by extension, the mixing ratio between the first liquid 31 and the second liquid 32 in the discharge liquid droplet, can be adjusted to a desired ratio.

When, for example, the first liquid is a clear ink and the second liquid is a cyan ink (or a magenta ink), a light cyan ink (or a light magenta ink) having various color material densities can be discharged by controlling the flow rate ratio $Q_r$. Alternatively, when the first liquid is a yellow ink and the second liquid is a magenta ink, multiple-type red inks of which hues are different in a stepwise manner can be discharged by controlling the flow rate ratio $Q_r$. In other words, when a liquid droplet in which the first liquid and the second liquid are mixed at a desired ratio can be discharged, a color reproduction range expressed by a print medium can be expanded as compared to the existing art by adjusting the mixing ratio.

Alternatively, when two-type liquids that are desirably not mixed until just before discharge and mixed just after the discharge are used as well, the configuration of the present embodiment is effective. There is, for example, a case where, in image printing, it is desirable to simultaneously apply a high concentration pigment ink excellent in color development and resin emulsion (resin EM) excellent in fastness like scratch resistance to a print medium. However, a pigment ingredient in the pigment ink and a solid content in the resin EM easily aggregate when an interparticle distance is proximate and tend to impair dispersibility. Thus, when, in the present embodiment, the first liquid 31 is a high concentration resin emulsion (resin EM) and the second liquid 32 is a high concentration pigment ink and then a parallel flow is formed by controlling the flow velocities of these liquids, the two liquids mix and aggregate on a print medium after discharged. In other words, it is possible to obtain an image having high color development and high fastness while maintaining a suitable discharge state under high dispersibility.

When such mixing of two liquids after discharged is intended, the effectiveness of flowing two liquids in the pressure chamber is exercised irrespective of the mode of the pressure generating element. In other words, even in such a configuration that restrictions on critical pressure or issues of kogation are originally not raised as in the case of, for example, a configuration in which a piezoelectric element is used as the pressure generating element, the present disclosure effectively functions.

As described above, according to the present embodiment, in a state where the first liquid and the second liquid are caused to steadily flow while maintaining a predetermined water phase thickness ratio $h_r$ in the pressure chamber, it is possible to stably perform good discharge operation by driving the pressure generating element 12.

By driving the pressure generating element 12 in a state where liquids are caused to steadily flow, a stable interface can be formed at the time of discharging liquid. When no liquid is flowing at the time of liquid discharge operation, the interface is easily disrupted due to occurrence of a bubble, which also influences printing quality. As in the case of the present embodiment, when the pressure generating element 12 is driven while liquids are caused to flow, disruption of the interface due to occurrence of a bubble can be suppressed. Since a stable interface is formed, for example, the content ratio of various liquids in discharge liquid becomes stable, and printing quality also gets better. Since liquids are caused to flow before driving the pressure generating element 12 and liquids are caused to flow also at the time of discharging, a time for forming a meniscus again in the pressure chamber after liquid is discharged is shortened. A flow of liquid is performed by a pump or the like installed in the liquid circulation unit 504 before a drive signal for the pressure generating element 12 is input. Therefore, liquid is flowing at least just before liquid is discharged.

The first liquid and the second liquid, flowing in the pressure chamber, may circulate through the outside of the pressure chamber. When no circulation is performed, there occurs a large amount of liquid not discharged, of the first liquid and the second liquid forming a parallel flow in the liquid channel and the pressure chamber. For this reason, when the first liquid and the second liquid are caused to circulate through the outside, it is possible to use liquid not discharged in order to form a parallel flow again.

Hereinafter, embodiments of the present disclosure will be described in detail with reference to the attached drawings. The first inflow channel 20 and the first common supply channel 23 are referred to as a first channel 3 when collectively referred. The second inflow channel 21 and the second common supply channel 28 are referred to as a second channel 4 when collectively referred.

First Embodiment

Figure 12:
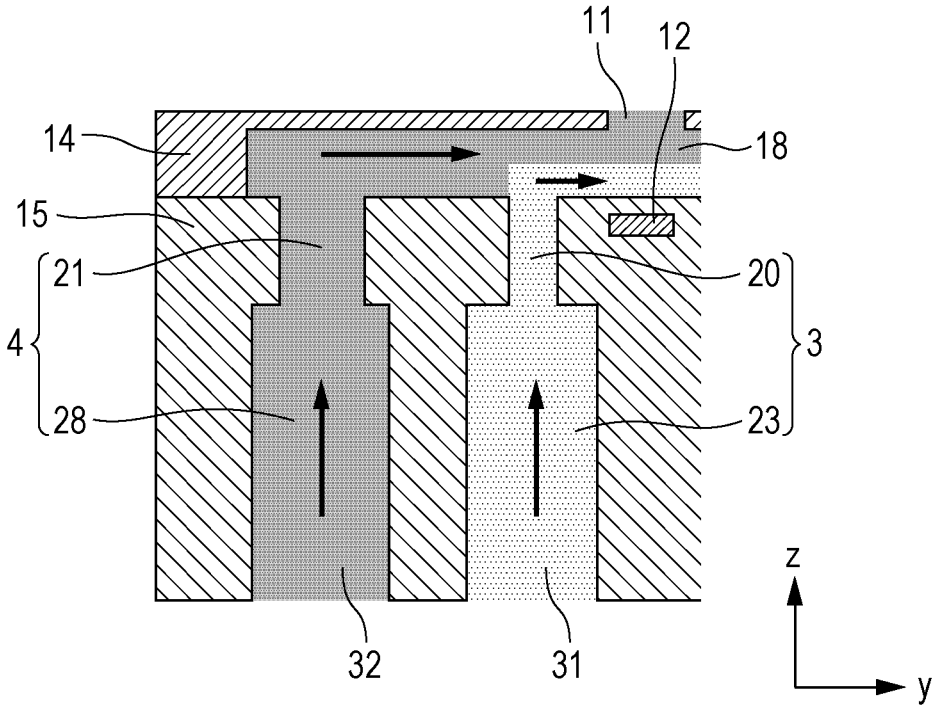
FIG. 12 is a cross-sectional view of the element substrate of a first embodiment.

FIG. 12 is a cross-sectional view of the element substrate 10 according to a first embodiment of the present disclosure and is an enlarged view of an area around the first inflow channel 20 and the second inflow channel 21. In other words, FIG. 12 is an enlarged view of an area of the element substrate 10 shown in FIG. 3 on the left side to the discharge port 11 in the drawing. As shown in FIG. 12, the first channel 3 and the second channel 4 are channels that extend through the substrate 15.

In the first embodiment, the width in the y direction (direction orthogonal to a direction in which the second liquid 32 flows in the second channel 4) of the second inflow channel 21 within the second channel 4 is greater than the width in the y direction of the first inflow channel 20. In other words, the average cross-section area of the second inflow channel 21 is greater than the average cross-section area of the first inflow channel 20. With this configuration, the flow resistance of the channel through which the second liquid 32 having a higher viscosity flows is reduced, so second liquid refillability improves. In other words, when it is assumed that the same liquid flows through two channels, the flow resistance of the second channel 4 is less than the flow resistance of the first channel 3.

The cross-section area of the first channel 3 is set to an appropriate value mainly with reference to a flow rate at which the first liquid 31 is supplied to the pressure chamber 18. Therefore, when the cross-section area of the second channel 4 is also set to a similar cross-section area, the refill efficiency of the second liquid is lower than the refill efficiency of the first liquid by the amount by which the viscosity of the second liquid is greater than the viscosity of the first liquid.

In addition, only the cross-section area of the second channel 4 is increased in the present embodiment, so the inner volume of through holes (the first channel 3 and the second channel 4) that extend through the substrate 15 is less than that when both the cross-section areas of the first channel 3 and second channel 4 are increased. For this reason, the strength of the element substrate 10 is maintained. Therefore, in the present embodiment, while the cross-section area of the second channel 4 is greater than the cross-section area of the first channel 3, the cross-section area of the first channel 3 is not changed from an appropriate value, so the refillability of the second liquid is improved while the strength of the substrate 15 is maintained.

The average cross-section area of the first channel 3 is an average value of cross-section areas at 30 points, acquired at equal intervals from one end portion of the first channel 3 toward the other end portion in a direction in which the first liquid 31 flows in the first channel 3 (z direction). Similarly, the average cross-section area of the second channel 4 is an average value of cross-section areas at 30 points, acquired at equal intervals from one end portion of the second channel 4 toward the other end portion in a direction in which the second liquid 32 flows in the second channel 4 (z direction).

The average cross-section area of the second channel 4 is greater than or equal to 1.1 times as large as the average cross-section area of the first channel 3. When the cross-section area of the second channel 4 is excessively increased, the strength of the substrate 15 decreases, and the element substrate 10 may be broken. For this reason, the average cross-section area of the second channel 4 is desirably less than or equal to 10 times as large as the average cross-section area of the first channel 3 and more desirably less than or equal to four times as large as the average cross-section area of the first channel 3.

Second Embodiment

Figure 13:
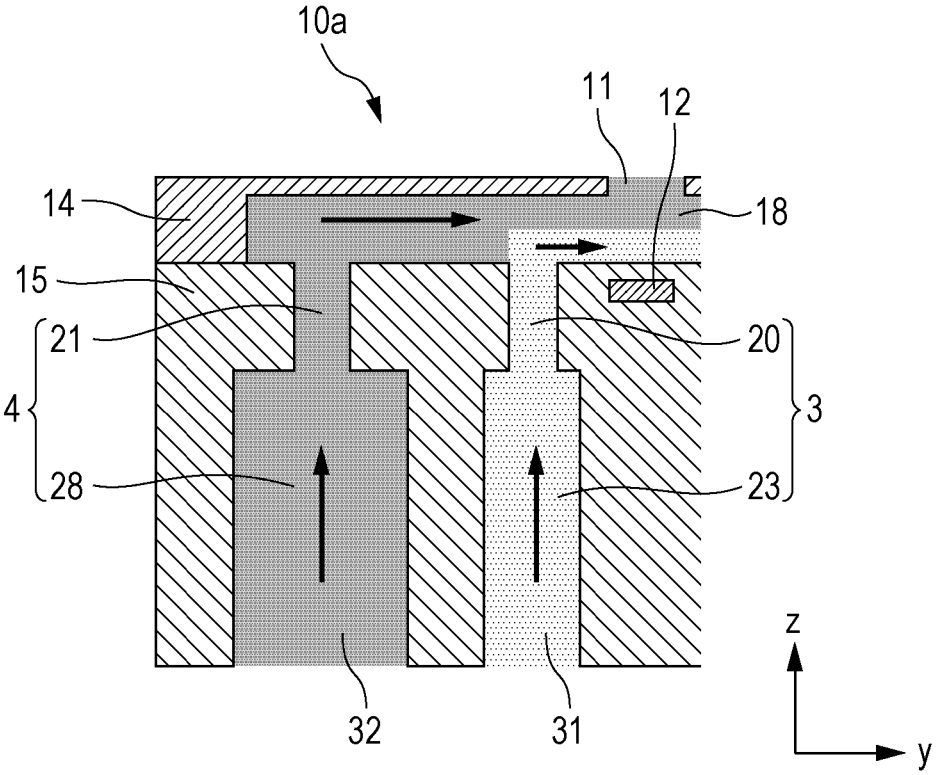
FIG. 13 is a cross-sectional view of an element substrate of a second embodiment.

A second embodiment will be described with reference to FIG. 13. Like reference signs denote similar portions to those of the first embodiment, and the description thereof is omitted. FIG. 13 is a cross-sectional view of an element substrate 10*a* according to the second embodiment of the present disclosure and is a diagram of a portion corresponding to FIG. 12. In the present embodiment, the width in the y direction of the second common supply channel 28 within the second channel 4 is greater than the width in the y direction of the first common supply channel 23. Thus, the average cross-section area of the second common supply channel 28 is greater than the average cross-section area of the first common supply channel 23. In other words, the average cross-section area of the second channel 4 is greater than the average cross-section area of the first channel 3 by the amount by which the average cross-section area of the second common supply channel 28 is increased.

According to the present embodiment, the flow resistance of the second common supply channel 28 decreases, so the refillability of the second liquid 32 improves. In addition, by increasing only the cross-section area of the second common supply channel 28, the strength of the element substrate 10*a* is maintained, so a breakage of the element substrate 10*a* is suppressed. By increasing the cross-section area of the second common supply channel 28 of which the length in the z direction is greater than that of the second inflow channel 21, the average cross-section area of the second channel 4 of the present embodiment is greater than the average cross-section area of the second channel 4 in the first embodiment. With this configuration, according to the present embodiment, the flow resistance is less than that of the first embodiment, so the refillability of the second liquid 32 improves.

Third Embodiment

Figure 14:
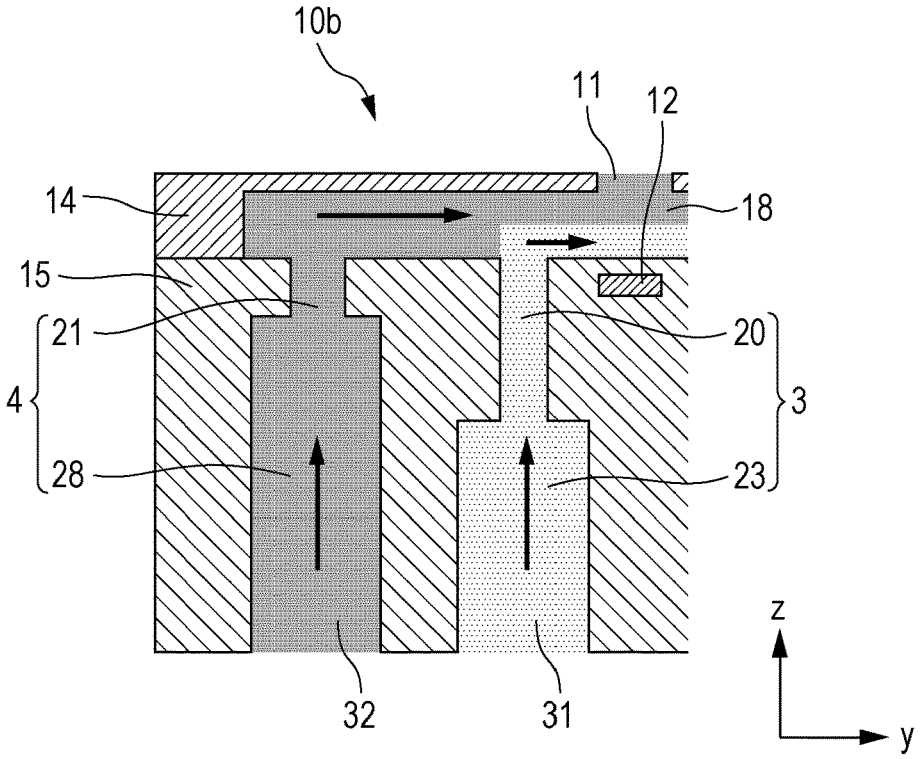
FIG. 14 is a cross-sectional view of an element substrate of a third embodiment.

A third embodiment will be described with reference to FIG. 14. Like reference signs denote similar portions to those of the first embodiment, and the description thereof is omitted. FIG. 14 is a cross-sectional view of an element substrate 10*b* according to the third embodiment of the present disclosure and is a diagram of a portion corresponding to FIG. 12. In the present embodiment, the widths in the y direction (cross-section areas) of the second inflow channel 21 and second common supply channel 28 are not increased, but the height (length in the z direction) of the second common supply channel 28 is greater than the height of the first common supply channel 23. In other words, although the cross-section area of each of the channels (the second inflow channel 21 and the second common supply channel 28) is not increased, a region in which the second common supply channel 28 having a large cross-section area is formed is increased. With this configuration, the average cross-section area of the second channel 4 is greater than the average cross-section area of the first channel 3, and the flow resistance in the second channel 4 is lower on the assumption that the same liquid flows. There are concerns about a decrease in the strength of the substrate 15; however, the height of the first common supply channel 23 is not increased, so a decrease in the strength, causing a breakage of the substrate 15, is suppressed. By increasing the length in the z direction of the second common supply channel 28 of which the cross-section area is greater than that of the second inflow channel 21, the average cross-section area of the second channel 4 of the present embodiment is greater than the average cross-section area of the second channel 4 in the first embodiment. With this configuration, according to the present embodiment, the flow resistance is less than that of the first embodiment, so the refillability of the second liquid 32 improves.

Thus, according to the present embodiment as well, while the refillability of the second liquid 32 is improved, a breakage of the element substrate 10*b* is suppressed.

Fourth Embodiment

Figure 15:
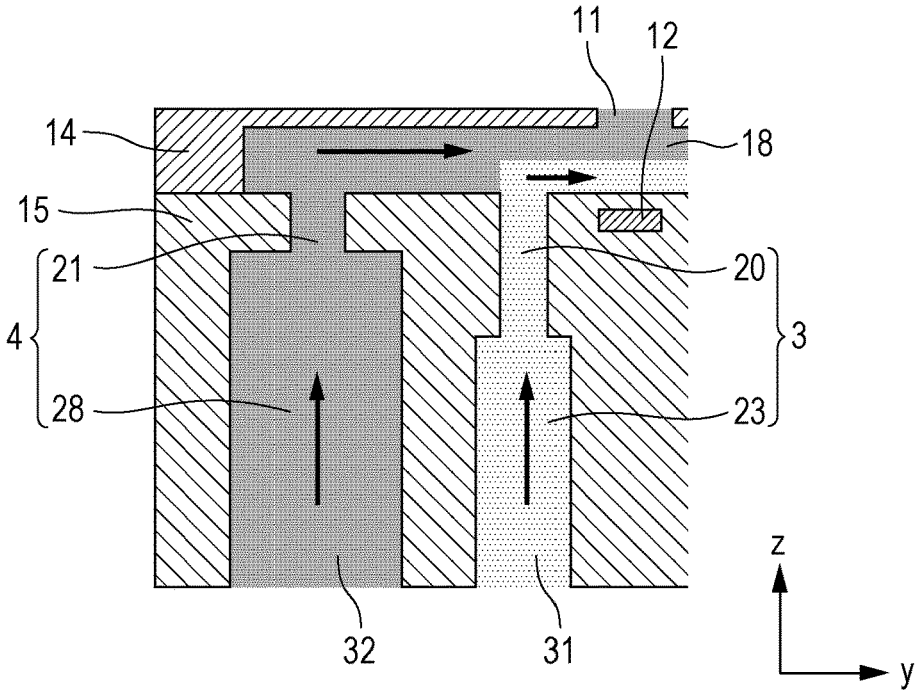
FIG. 15 is a cross-sectional view of an element substrate of a fourth embodiment.

A fourth embodiment will be described with reference to FIG. 15. Like reference signs denote similar portions to those of the first embodiment, and the description thereof is omitted. FIG. 15 is a cross-sectional view of an element substrate 10*c* according to the fourth embodiment of the present disclosure and is a diagram of a portion corresponding to FIG. 12. In the present embodiment, the cross-section area of a surface perpendicular to the z direction of the second common supply channel 28 is greater than the cross-section area of a surface perpendicular to the z direction of the first common supply channel 23, and the height in the z direction of the second common supply channel 28 is greater than the height in the z direction of the first common supply channel 23. With this configuration, the flow resistance of the second channel 4 is decreased, so a breakage of the element substrate 10*c* is suppressed while the refillability of the second liquid 32 is improved. When the cross-section area of the second common supply channel 28 of which the length in the z direction is greater than that of the second inflow channel 21 is increased and the length in the z direction of the second common supply channel 28 is increased, the average cross-section area of the second channel 4 is greater than the average cross-section area of the second channel 4 in each of the above-described embodiments. With this configuration, according to the present embodiment, the flow resistance is less than that of each of the above-described embodiments, so the refillability of the second liquid 32 improves.

Other Embodiments

Other embodiments will be described with reference to FIG. 16A to FIG. 16D. Like reference signs denote similar portions to those of the first embodiment, and the description thereof is omitted. FIG. 16A to FIG. 16D are cross-sectional views of an element substrate 10*d* according to the other embodiments of the present disclosure. In the above-described embodiments, the cross-section area of a channel is set as needed focusing on a channel upstream of the pressure chamber 18; however, embodiments of the present disclosure may focus on a channel downstream of the pressure chamber 18. In other words, the first outflow channel 25 and the second outflow channel 26 that flow a liquid from the liquid channel 13, the first common collecting channel 24 that collects the first liquid 31 from the first outflow channel 25 and the second common collecting channel 29 that collects the second liquid 32 from the second outflow channel 26 may be focused. Hereinafter, the first outflow channel 25 and the first common collecting channel 24 are referred to as a third channel 5 when collectively referred, and the second outflow channel 26 and the second common collecting channel 29 are referred to as a fourth channel 6 when collectively referred.

Figure 16A:
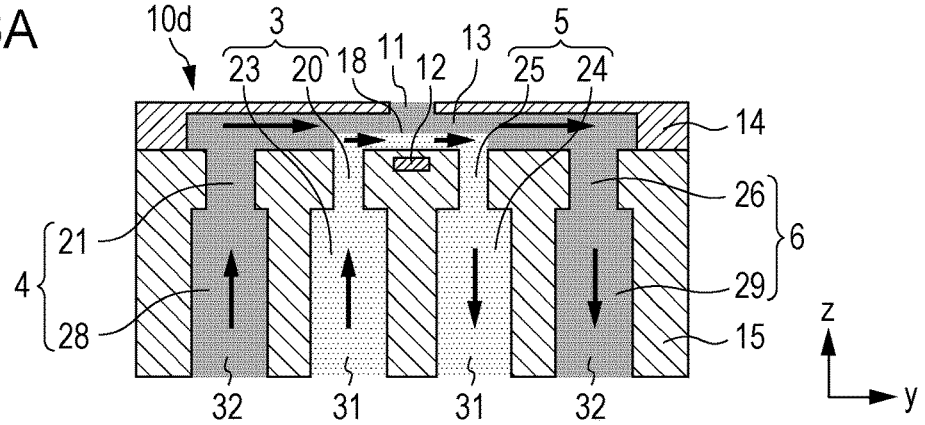
FIG. 16A to FIG. 16D are cross-sectional views of element substrates of other embodiments.
Figure 16B:
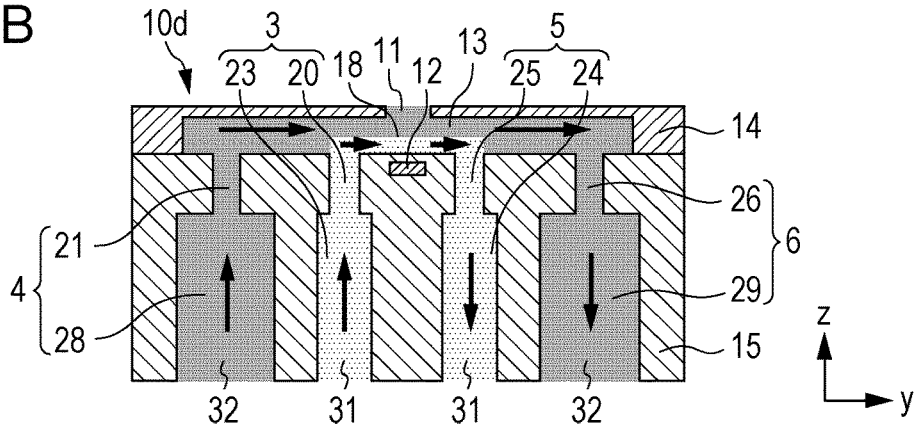
Figure 16C:
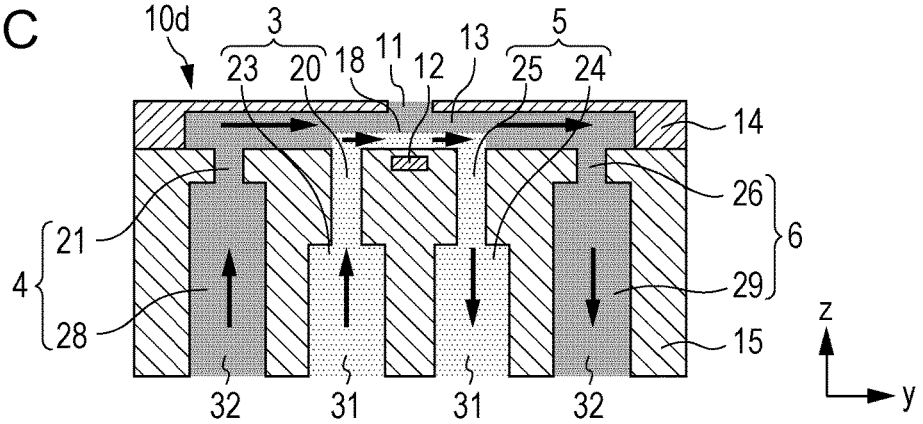
Figure 16D:
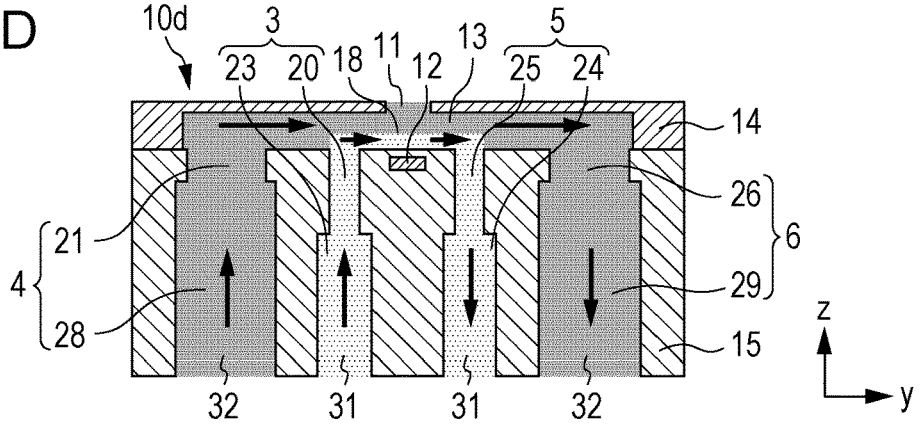

FIG. 16A shows the element substrate 10*d* when the average cross-section area of not only the second inflow channel 21 but also the second outflow channel 26 is increased. FIG. 16B shows the element substrate 10*d* when the average cross-section area of not only the second common supply channel 28 but also the second common collecting channel 29 is increased. FIG. 16C shows the element substrate 10*d* when the height of not only the second common supply channel 28 but also the second common collecting channel 29 is increased. FIG. 16D shows the element substrate 10*d* when the cross-section area and height of not only the second common supply channel 28 but also the second common collecting channel 29 are increased. As shown in FIG. 16A to FIG. 16D, when the average cross-section area of the fourth channel 6 is made greater than the average cross-section area of the third channel 5, the second liquid 32 is easily collected and, by extension, the refillability of the second liquid also improves. As in the case of the above-described embodiments, by increasing only the cross-section area of a channel through which the second liquid 32 flows, the strength of the element substrate 10*d* is maintained, so a breakage of the element substrate 10*d* is suppressed.

Manufacturing Method

Manufacturing steps for the element substrate 10 in the first embodiment will be described with reference to FIG. 17A to FIG. 17H, and FIG. 18. FIG. 17A to FIG. 17H are cross-sectional views of the element substrate 10 in the manufacturing steps. FIG. 18 is a flowchart of the manufacturing steps shown in FIG. 17A to FIG. 17H.

Figure 17A:
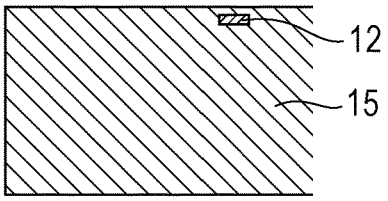
FIG. 17A to FIG. 17H are views showing a manufacturing process for the element substrate of the first embodiment.
Figure 17B:
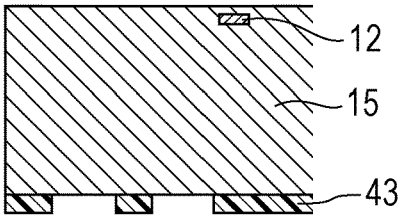
Figure 17C:
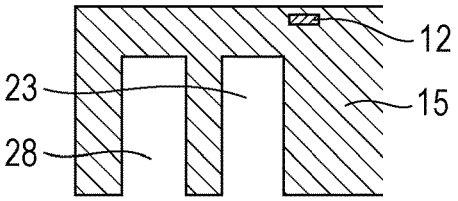
Figure 17D:
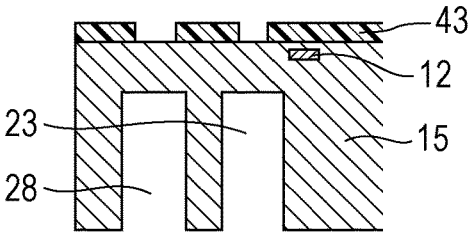
Figure 17E:
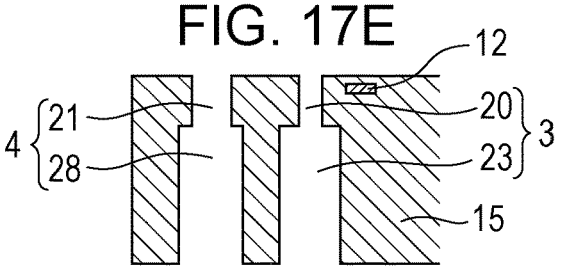
Figure 18:
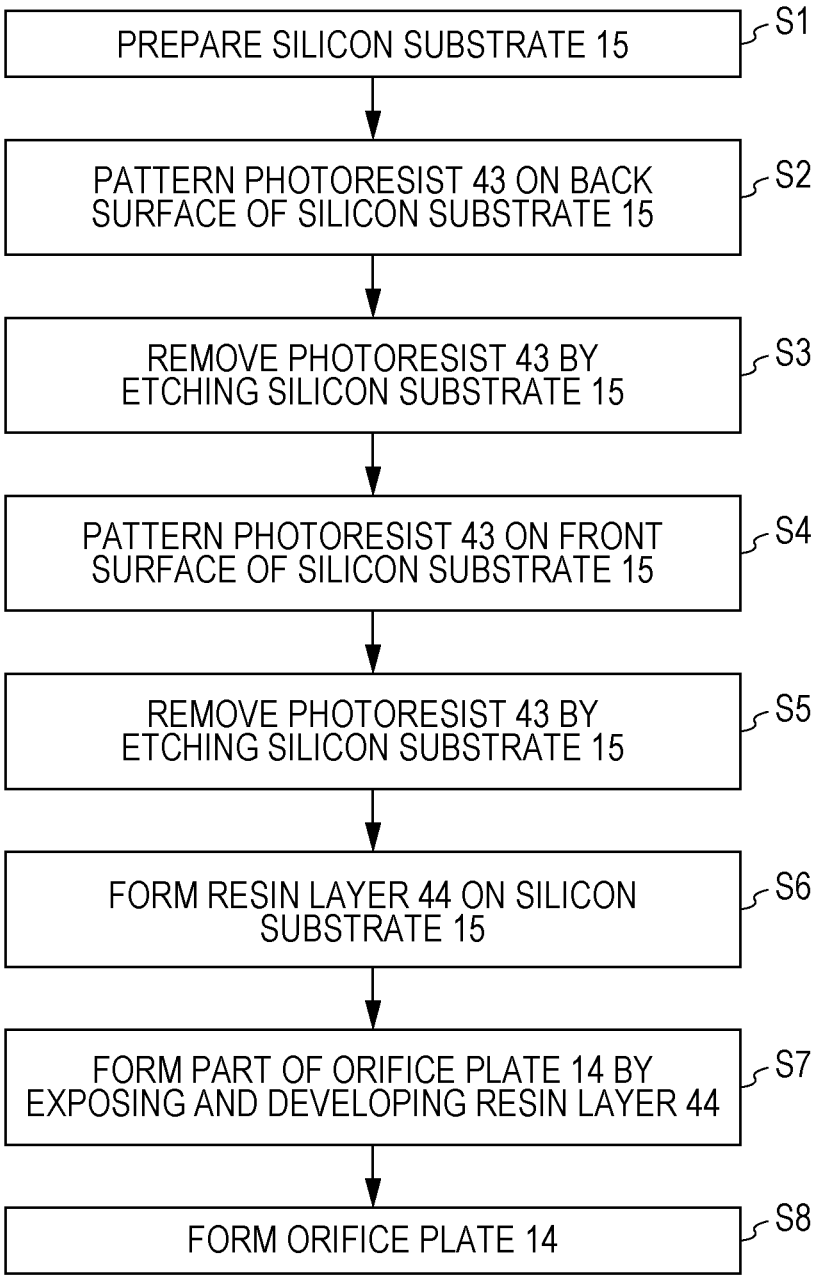
FIG. 18 is a flowchart of the manufacturing process for the element substrate of the first embodiment.

Initially, the silicon substrate 15 including the pressure generating element 12 is prepared (FIG. 17A, step S1). Subsequently, a photoresist 43 is patterned on the back surface of the silicon substrate 15 (FIG. 17B, step S2). Subsequently, the silicon substrate 15 is etched by using the patterned photoresist 43 as an etching mask (first etching step), and, after etching, the photoresist 43 is removed (FIG. 17C, step S3). In step S3, etching is performed from the back surface of the silicon substrate 15 on the opposite side of the surface on which the pressure generating element 12 is present. Through etching of step S3, the first common supply channel 23 and the second common supply channel 28 are formed. After that, a photoresist 43 is patterned on the front surface of the silicon substrate 15 (FIG. 17D, step S4). Subsequently, the silicon substrate 15 is etched by using the patterned photoresist 43 as an etching mask (second etching step), and, after etching, the photoresist 43 is removed (FIG. 17E, step S5). Through etching of step S5, the first inflow channel 20 and the second inflow channel 21 are formed. At this time, the silicon substrate 15 is etched such that the average cross-section area of the second inflow channel 21 is greater than the average cross-section area of the first inflow channel 20. At this time, by, for example, changing the width of the mask opening of the photoresist 43 as an etching mask patterned on the front surface of the silicon substrate 15 or changing an etching rate, the cross-section area of the second inflow channel 21 can be increased. Up to the above-described step, the first channel 3 and the second channel 4 that each extend through the silicon substrate 15 are formed.

Figure 17F:
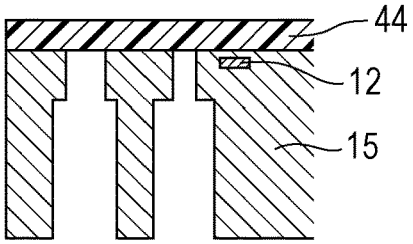

Subsequently, a resin layer 44 is formed on the silicon substrate 15 (FIG. 17F, step S6). For example, a negative-type photosensitive resin is used as the resin layer 44, The resin layer 44 is prepared by, for example, dripping 20 cc resin on a support made of polyethylene terephthalate with a thickness of 100 μm, then forming a layer by means of spin coating, and applying a baking process at 100° C. for 20 minutes. After that, the resin layer 44 is transferred from the support to the silicon substrate 15 by laminating the resin layer 44 on the silicon substrate 15. Laminate conditions are, for example, a laminate pressure of 300 kPa, a laminate temperature of 70° C., and a laminate rate of 1 mm/sec.

Figure 17G:
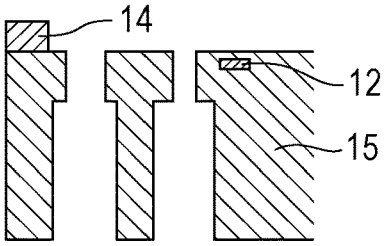
Figure 17H:
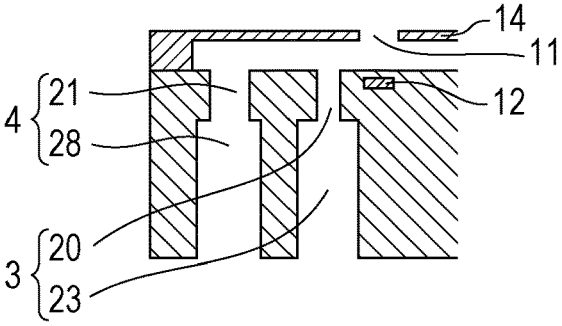

Subsequently, part of the orifice plate 14 is formed by exposing the resin layer 44 with a photo mask and developing the resin layer 44 (FIG. 17G, step S7). Subsequently, the orifice plate 14 having the discharge port 11 is formed by performing a process similar to step S6 and step S7 (FIG. 17H, step S8). Through the above steps, the element substrate 10 in the first embodiment is prepared.

The element substrates of the other embodiments can be manufactured as needed by changing the depth or width or both of etching.

Comparative Example

Figure 19:
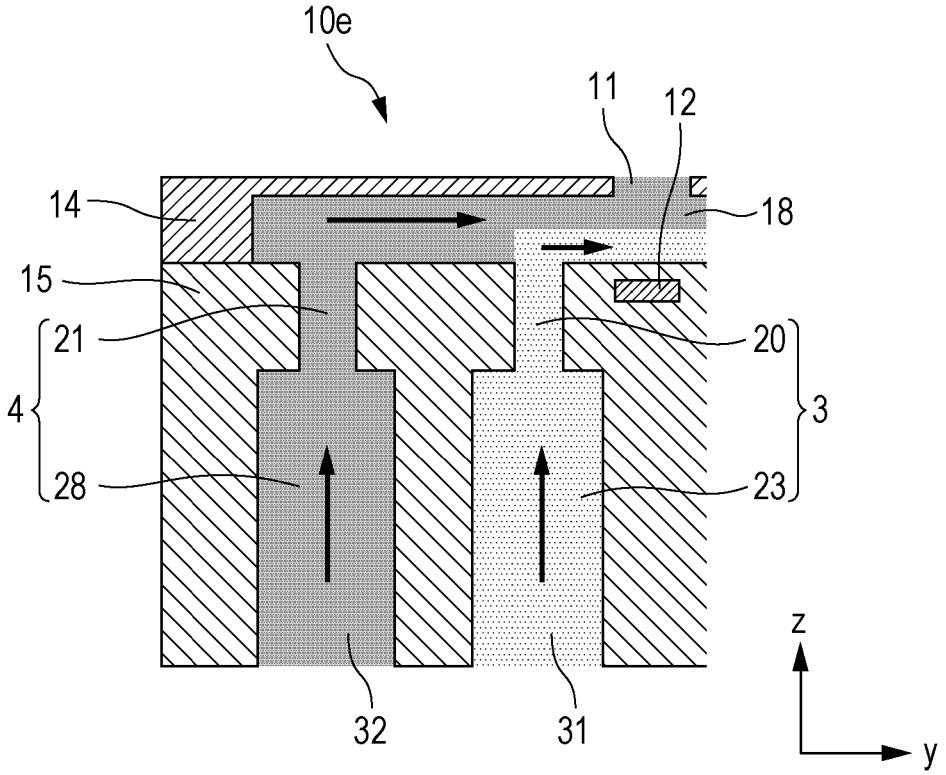
FIG. 19 is a cross-sectional view of an element substrate in a comparative example.

A comparative example of the present disclosure will be described with reference to FIG. 19. Like reference signs denote similar portions to those of the embodiments of the present disclosure, and the description thereof is omitted. FIG. 19 shows an element substrate 10*e* of the comparative example. In the comparative example, the average cross-section area of the first channel 3 is equal to the average cross-section area of the second channel 4. Therefore, on the assumption that the same liquid flows through the first channel 3 and the second channel 4, the flow resistance of the first channel 3 is substantially equal to the flow resistance of the second channel 4. Particularly, the second liquid 32 has a greater viscosity than the first liquid 31, so the second channel 4 through which the second liquid 32 flows has a greater flow resistance. For this reason, the refillability of the second liquid 32 is lower than the refillability of the first liquid 31.

When the cross-section areas of the first channel 3 and second channel 4 are uniformly increased in order to improve the refillability of the liquids, the inner volume of the through holes (channels) that extend through the substrate 15 increases, so the strength of the element substrate 10*e* decreases. When the strength of the element substrate 10*e* decreases, there are concerns about a breakage of the element substrate 10*e*.

Therefore, as described above, in the embodiments of the present disclosure, the cross-section areas of the channels that extend through the substrate 15 are not simply increased but, in view of the balance between refillability and strength, only the second channel 4 through which the second liquid 32 having a greater flow resistance and a lower refillability flows is increased. With this configuration, while, particularly, the refillability of the second liquid 32 having a lower refillability is improved, the inner volume of the through holes (channels) that extend through the substrate 15 is reduced, so a breakage of the element substrate is suppressed.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2020-084708, filed May 13, 2020, which is hereby incorporated by reference herein in its entirety.

What is claimed is:

1. A liquid discharge head comprising:

a substrate;

a pressure chamber through which a first liquid and a second liquid flow while being in contact with each other;

a pressure generating element configured to pressurize the first liquid; and a discharge port configured to discharge the second liquid, wherein the substrate has a first channel and a second channel that each extend through the substrate, the first channel is used to supply the first liquid to the pressure chamber, the second channel is used to supply the second liquid to the pressure chamber, a viscosity of the second liquid is greater than a viscosity of the first liquid, and an average cross-section area of the second channel is greater than an average cross-section area of the first channel.

2. The liquid discharge head according to claim 1, further comprising:

a liquid channel formed on the substrate and communicating with the pressure chamber, wherein the second channel includes a second inflow channel used to flow the second liquid into the liquid channel, and a second common supply channel used to supply the second liquid to the second inflow channel, the first channel includes a first inflow channel used to flow the first liquid into the liquid channel, and a first common supply channel used to supply the first liquid to the first inflow channel, and a cross-section area of the second inflow channel is greater than a cross-section area of the first inflow channel.

3. The liquid discharge head according to claim 1, further comprising:

a liquid channel formed on the substrate and communicating with the pressure chamber, wherein the second channel includes a second inflow channel used to flow the second liquid into the liquid channel, and a second common supply channel used to supply the second liquid to the second inflow channel, the first channel includes a first inflow channel used to flow the first liquid into the liquid channel, and a first common supply channel used to supply the first liquid to the first inflow channel, and a cross-section area of the second common supply channel is greater than a cross-section area of the first common supply channel.

4. The liquid discharge head according to claim 1, further comprising:

a liquid channel formed on the substrate and communicating with the pressure chamber, wherein the second channel includes a second inflow channel used to flow the second liquid into the liquid channel, and a second common supply channel used to supply the second liquid to the second inflow channel, the first channel includes a first inflow channel used to flow the first liquid into the liquid channel, and a first common supply channel used to supply the first liquid to the first inflow channel, and a length of the second common supply channel in a direction in which the second liquid flows is greater than a length of the first common supply channel in a direction in which the first liquid flows.

5. The liquid discharge head according to claim 1, wherein the substrate has a third channel and a fourth channel that each extend through the substrate, the third channel is used to collect the first liquid from the pressure chamber, the fourth channel is used to collect the second liquid from the pressure chamber, and an average cross-section area of the fourth channel is greater than an average cross-section area of the third channel.

6. The liquid discharge head according to claim 5, further comprising:

a liquid channel formed on the substrate and communicating with the pressure chamber, wherein the third channel includes a first outflow channel used to flow the first liquid from the liquid channel, and a first common collecting channel used to collect the first liquid from the first outflow channel, the fourth channel includes a second outflow channel used to flow the second liquid from the liquid channel, and a second common collecting channel used to collect the second liquid from the second outflow channel, and a cross-section area of the second outflow channel is greater than a cross-section area of the first outflow channel.

7. The liquid discharge head according to claim 5, further comprising:

a liquid channel formed on the substrate and communicating with the pressure chamber, wherein the third channel includes a first outflow channel used to flow the first liquid from the liquid channel, and a first common collecting channel used to collect the first liquid from the first outflow channel, the fourth channel includes a second outflow channel used to flow the second liquid from the liquid channel, and a second common collecting channel used to collect the second liquid from the second outflow channel, and a cross-section area of the second common collecting channel is greater than a cross-section area of the first common collecting channel.

8. The liquid discharge head according to claim 5, further comprising:

a liquid channel formed on the substrate and communicating with the pressure chamber, wherein the third channel includes a first outflow channel used to flow the first liquid from the liquid channel, and a first common collecting channel used to collect the first liquid from the first outflow channel, the fourth channel includes a second outflow channel used to flow the second liquid from the liquid channel, and a second common collecting channel used to collect the second liquid from the second outflow channel, and a length of the second common collecting channel in a direction in which the second liquid flows is greater than a length of the first common collecting channel in a direction in which the first liquid flows.

9. The liquid discharge head according to claim 1, wherein the cross-section area of the second channel is greater than or equal to 1.1 times as large as the cross-section area of the first channel.

10. The liquid discharge head according to claim 1, wherein the cross-section area of the second channel is less than or equal to three times as large as the cross-section area of the first channel.

11. A liquid discharge apparatus comprising the liquid discharge head according to claim 1.

12. A liquid discharge module that is a component of the liquid discharge head according to claim 1, wherein the liquid discharge head is configured such that a plurality of the liquid discharge modules is arranged.

13. A manufacturing method for a liquid discharge head, the liquid discharge head including:

a substrate;

a pressure chamber through which a first liquid and a second liquid flow while being in contact with each other;

a pressure generating element configured to pressurize the first liquid;

a discharge port configured to discharge the second liquid;

a liquid channel formed on the substrate and communicating with the pressure chamber;

a first inflow channel used to flow the first liquid into the liquid channel;

a first common supply channel used to supply the first liquid to the first inflow channel;

a second inflow channel used to flow the second liquid into the liquid channel; and a second common supply channel used to supply the second liquid to the second inflow channel, a viscosity of the second liquid being greater than a viscosity of the first liquid, the manufacturing method comprising:

preparing the substrate including the pressure generating element;

patterning a photoresist on a back surface of the substrate, the back surface being an opposite side of a surface on which the pressure generating element is present;

forming the first common supply channel and the second common supply channel by etching the substrate from the back surface of the substrate;

patterning a photoresist on the surface of the substrate, on which the pressure generating element is present;

forming the first inflow channel and the second inflow channel by etching the substrate from the surface of the substrate, on which the pressure generating element is present; and forming the pressure chamber on the substrate and the discharge port above the substrate, wherein the first common supply channel and the second common supply channel are formed by etching such that an average cross-section area of the second common supply channel is greater than an average cross-section area of the first common supply channel or the first inflow channel and the second inflow channel are formed by etching such that an average cross-section area of the second inflow channel is greater than an average cross-section area of the first inflow channel.

* * * * *